US007270924B2

(12) United States Patent
Kami

(10) Patent No.: US 7,270,924 B2
(45) Date of Patent: Sep. 18, 2007

(54) ELECTROPHOTOGRAPHIC PHOTORECEPTOR, METHOD FOR MANUFACTURING THE ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

(75) Inventor: Hidetoshi Kami, Numazu (JP)

(73) Assignee: Ricoh Company Limited, Tokyo (JP)

( * ) Notice: Subject to any disclaimer, the term of this patent is extended or adjusted under 35 U.S.C. 154(b) by 318 days.

(21) Appl. No.: 10/803,256

(22) Filed: Mar. 19, 2004

(65) Prior Publication Data

US 2004/0185358 A1 Sep. 23, 2004

(30) Foreign Application Priority Data

Mar. 19, 2003 (JP) ..... 2003-076650

(51) Int. Cl.
*G03G 5/047* (2006.01)

(52) U.S. Cl. ..... 430/58.05; 430/58.7; 430/66; 430/132

(58) Field of Classification Search ..... 430/58.7, 430/56, 58.05, 66, 132
See application file for complete search history.

(56) References Cited

U.S. PATENT DOCUMENTS

| | | | | |
|---|---|---|---|---|
| 3,948,656 | A * | 4/1976 | Maxwell | 430/94 |
| 5,871,876 | A | 2/1999 | Ikuno et al. | |
| 5,942,361 | A * | 8/1999 | Hoshizaki et al. | 430/58.7 |
| 6,030,733 | A | 2/2000 | Kami et al. | |
| 6,183,921 | B1 * | 2/2001 | Yu et al. | 430/58.7 |
| 6,326,112 | B1 | 12/2001 | Tamura et al. | |
| 6,573,016 | B2 | 6/2003 | Kami et al. | |
| 6,641,964 | B2 | 11/2003 | Ikuno et al. | |
| 6,653,033 | B1 | 11/2003 | Kami et al. | |
| 6,936,388 | B2 * | 8/2005 | Suzuki et al. | 430/66 |
| 2003/0073015 | A1 * | 4/2003 | Tamoto et al. | 430/66 |
| 2003/0113642 | A1 * | 6/2003 | Kami et al. | 430/57.2 |

FOREIGN PATENT DOCUMENTS

| | | |
|---|---|---|
| JP | 6-313972 | 11/1994 |
| JP | 7-13374 | 1/1995 |
| JP | 7-43920 | 2/1995 |
| JP | 7-44065 | 2/1995 |
| JP | 7-92701 | 4/1995 |
| JP | 8-22136 | 1/1996 |
| JP | 8-152721 | 6/1996 |
| JP | 9-211876 | 8/1997 |
| JP | 10-69104 | 3/1998 |
| JP | 10-115946 | 5/1998 |
| JP | 10-123802 | 5/1998 |
| JP | 10-123855 | 5/1998 |
| JP | 10-123856 | 5/1998 |
| JP | 10-177261 | 6/1998 |
| JP | 10-177262 | 6/1998 |
| JP | 10-177263 | 6/1998 |
| JP | 10-177264 | 6/1998 |
| JP | 10-177269 | 6/1998 |
| JP | 10-186696 | 7/1998 |
| JP | 10-246997 | 9/1998 |
| JP | 11-133825 | 5/1999 |
| JP | 11-184127 | 7/1999 |
| JP | 11-184135 | 7/1999 |
| JP | 2000-75521 | 3/2000 |
| JP | 2000-105478 | 4/2000 |
| JP | 2000-112162 | 4/2000 |
| JP | 2000-147803 | 5/2000 |
| JP | 2000-214602 | 8/2000 |
| JP | 2000-231246 | 8/2000 |
| JP | 2000-292946 | 10/2000 |
| JP | 2001-51438 | 2/2001 |
| JP | 2001-117244 | 4/2001 |
| JP | 2001-235889 | 8/2001 |
| JP | 2001-255685 | 9/2001 |
| JP | 2001-305762 | 11/2001 |
| JP | 2001-305763 | 11/2001 |
| JP | 2002-6528 | 1/2002 |
| JP | 2002-107972 | 4/2002 |
| JP | 2002-107983 | 4/2002 |
| JP | 2002-123067 | 4/2002 |
| JP | 2002-341571 | 11/2002 |
| JP | 2002-365822 | 12/2002 |

OTHER PUBLICATIONS

U.S. Appl. No. 08/862,260, filed May 23, 1997, Kishida et al.
U.S. Appl. No. 09/985,347, filed Nov. 2, 2001, Tamoto et al.
U.S. Appl. No. 10/103,791, filed Mar. 25, 2002, Suzuki et al.
U.S. Appl. No. 10/135,548, filed May 1, 2002, Kami et al.
U.S. Appl. No. 10/235,961, filed Sep. 6, 2002, Ikegami et al.
U.S. Appl. No. 11/007,784, filed Dec. 9, 2004, Kondo, et al.
U.S. Appl. No. 11/030,307, filed Jan. 7, 2005, Kami, et al.
U.S. Appl. No. 11/016,708, filed Dec. 21, 2004, Kitajima, et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A photoreceptor including an electroconductive substrate, a photosensitive layer located overlying the substrate, and a protective layer overlying the photosensitive layer, wherein the photoreceptor has a property such that when the photoreceptor is charged so as to have a potential of −700 V and then exposed to light with exposure of 0.4 μJ/cm$^2$, the potential ($P_L$) of a lighted portion of the photoreceptor decreases at a rate not greater than 700 V/sec during a time period of from a time 35 msec after the exposure to the transition time of the photoreceptor. An image forming apparatus and a process cartridge including the photoreceptor are also provided.

10 Claims, 10 Drawing Sheets

IN LATENT IMAGE FORMATION PROCESS

IN DEVELOPMENT PROCESS

AFTER TRANSFER PROCESS

ELECTROPHOTOGRAPHIC PHOTORECEPTOR, METHOD FOR MANUFACTURING THE ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

BACKGROUND OF THE INVENTION

1. Field of the Invention

The present invention relates to an electrophotographic photoreceptor, a method for manufacturing the photoreceptor, and an image forming apparatus and a process cartridge using the electrophotographic photoreceptor. More particularly, the present invention relates to an electrophotographic photoreceptor for use in electrophotographic image forming apparatus such as copiers, facsimiles, laser printers, and direct digital plate making machines, and a method for manufacturing the photoreceptor, and an image forming apparatus and a process cartridge using the electrophotographic photoreceptor.

2. Discussion of the Background

The photosensitive material for use in the photoreceptors for electrophotographic image forming apparatus such as copiers and laser printers has changed from inorganic photosensitive materials such as selenium, zinc oxide and cadmium sulfide to organic photosensitive materials. This is because organic photosensitive materials are friendly to environment, and have low manufacturing costs; and good designing flexibility.

Organic photoreceptors are broadly classified into the following three types:

(1) homogeneous single-layered photoreceptors in which, for example, a photoconductive resin such as polyvinyl carbazole (PVK) or a charge transfer complex such as PVK-TNF (2,4,7-trinitrofluorenone) is formed on an electroconductive substrate;

(2) dispersion type single-layered photoreceptors in which a resin layer including a pigment such as phthalocyanine and perylene dispersed in the resin is formed on an electroconductive substrate; and (3) functionally-separated multi-layered photoreceptors in which a charge generation layer (hereinafter referred to as a CGL) including a charge generation material (hereinafter referred to as a CGM) and a charge transport layer (hereinafter referred to as a CTL) including a charge transport material (hereinafter referred to as a CTM) are overlaid on an electroconductive substrate.

The functionally-separated multi-layered photoreceptors typically have a structure in which a CTL is formed on a CGL. Functionally-separated multi-layered photoreceptors having a reverse structure are sometimes referred to as reverse-layered photoreceptors.

In particular, the functionally-separated multi-layered photoreceptors have advantages of having high photosensitivity and good flexibility in designing photoreceptors having high photosensitivity and good durability. Therefore, recently the functionally-separated multi-layered photoreceptors are widely used for electrophotographic image forming apparatus.

In recent years, it is very important to manufacture products while considering influence thereof on the global environment. Therefore, photoreceptors to be used in electrophotographic image forming apparatus are required to be one of mechanical parts instead of a supply (i.e., a disposable product). In other words, photoreceptors are required to have a long life. Therefore, recent photoreceptors typically have a protective layer located on a photosensitive layer.

On the other hand, as for the toner for use developing latent images formed by electrophotography, polymerized-toners, spherical toners and small-sized toners (having an average particle diameter not greater than 6 μm) have been widely used because of being friendly to global environment and being able to produce high quality images. In order that photoreceptors have good cleanability against such toners, a protective layer is typically formed on the surface of the photoreceptors.

The photoreceptors having a protective layer thereon tend to cause problems in that a ghost of a previously formed image is formed in the following images (hereinafter referred to as a residual image problem or a ghost image problem). In other words, there is no photoreceptor which has good combination of durability, toner cleanability and image quality.

Particularly, in high speed image forming apparatus such that the interval between the light irradiation process and the following development process (hereinafter referred to as the exposure-development interval) is not greater than 100 msec, the residual image problem tends to occur. This problem hardly occurs in low- or medium-speed image forming apparatus. In the present application, high speed image forming apparatus are defined as an apparatus in which the exposure-development interval is not greater than 100 msec.

The residual image problem will be explained in detail.

When a half-tone image is formed following an image which has only light image portions and dark image portions as illustrated in FIG. 14, there is a case where a residual image (positive or negative image) of the image can be observed in the half-tone image as illustrated in FIGS. 15 and 16. These images are so called "a positive residual image" or "a positive ghost image" (illustrated in FIG. 15) and "a negative residual image" or "a negative ghost image" (illustrated in FIG. 16). It is necessary to prevent formation of such a residual image problem particularly in high quality full color image forming apparatus.

The mechanism of formation of a residual image is considered to be caused by fluctuation of the surface potential of the photoreceptor as discussed in published unexamined Japanese Patent Application (hereinafter JOP) 11-133825. The mechanism will be explained referring to FIG. 17.

FIG. 17A illustrates the surface potential of a photoreceptor after the photoreceptor is charged so as to have a potential of −700 V and then exposed to imagewise light (i.e., the surface potential of an electrostatic latent image formed on the photoreceptor). In this case, the surface potential of the lighted portion is about 0 V. FIG. 17B illustrates the surface potential of the photoreceptor after the latent image is developed with a toner (i.e., the surface potential of the photoreceptor having a toner image thereon). FIG. 17C illustrates the surface potential of the photoreceptor after the toner image is transferred onto a receiving paper while a reverse bias is applied to the receiving paper. In this case, the lighted portions have a certain positive potential (for example, +10 V in FIG. 17C).

When the photoreceptor is charged after these image forming processes are repeated, the surface potential (for example, −690 V) of the former image portion is lower than that (i.e., −700 V) of the other portions. If a half-tone image is formed on an area including the former image portion and a former non-image portion, the difference in potential between the former image portion and a non-lighted portion is larger than that between the former non-image portion and the non-lighted portion, and thereby a dense image (a positive image) is formed on the former image portion.

As discussed in JOP 2002-123067, the residual image problem is also caused in a digital image forming method in which half tone images constituted of digital dot images are formed similarly to the inkjet printing methods.

Specifically, the illuminance in a beam spot formed on a photoreceptor to form a latent dot image thereon is not uniform and has a certain distribution in a direction of from the center to the periphery of the beam spot. When a beam spot is formed on the former image portion, the resultant latent dot image portion has a larger area than the other latent dot image portions because the potential of the latent dot image portion is biased by, for example, +10 V. Thus, the resultant dot toner image has a large diameter than that of the dot image in other portions, and thereby the portions of the widened dot image potions are observed to be dense, resulting in formation of a residual positive image. This phenomenon is more prominent in high definition image formation with resolution of 1200 dpi than in image formation with resolution of 600 dpi.

As discussed in JOP 10-177261, the main reason for the fluctuation of surface potential is considered to be that space charges are stored in the inside of a photoreceptor. In attempting to prevent storage of space charges, the following methods have been disclosed.

(1) Improvement of Outermost Layer of Photoreceptor

JOP 10-115946 discloses a photoreceptor having an outermost layer which includes a polyarylate resin and which has a dielectric constant not less than 2.3.

JOP 11-184135 discloses a photoreceptor having a photosensitive layer including an azo pigment and an outermost layer including a polyarylate resin. According to the publication, polyarylate resins have high crystallinity, and therefore can orient the CTM included therein to some extent. It is considered that by orienting the CTM and using the specific azo pigment, the charge injection barrier can be decreased and thereby the photo-memory property of the photoreceptor can be diminished.

JOP 10-177263 discloses that a photoreceptor having a CGL including a phthalocyaine compound and an outermost layer including a bisphenol-based polycarbonate is used for an electrophotographic image forming apparatus having an intermediate transfer medium.

JOP 10-177264 discloses that a photoreceptor having a CGL including a phthalocyaine compound and an outermost layer including a charge transport polymer is used for an electrophotographic image forming apparatus having an intermediate transfer medium.

JOP 10-177269 discloses that a photoreceptor having a CGL including a phthalocyanine compound and either an insulative outermost layer or a semiconductive outermost layer including at least a resistance controlling agent is used for an electrophotographic image forming apparatus having an intermediate transfer medium.

JOP 2000-147803 discloses a photoreceptor in which a polycarbonate copolymer obtained from bisphenol A and a monomer having a specific arylene group is used for the outermost layer thereof such as the CTL. It is discussed in the publication that injection of charges having a reverse polarity from the outermost layer side can be prevented.

JOP 2001-235889 discloses a photoreceptor having an outermost layer including a surface-treated particulate metal oxide, an alcohol-soluble resin and an alcohol-soluble CTM. It is described in the publication that thermoplastic resins cannot be used as the binder resin of the outermost layer because the resins have insufficient mechanical strength and solvents used for dissolving the resins also dissolve the photosensitive layer. It is considered that use of an alcohol-soluble CTM prevents formation of residual images.

JOP 2002-6528 discloses a photoreceptor having a photosensitive layer and a protective layer including at least one of an alkali metal element and an alkali earth metal element. It is described therein that by including such an element in the protective layer, ionic conduction property can be imparted to the protective layer, and thereby a photoreceptor which has good durability and which does not store residual charges can be provided. It is also described therein that it is possible to reduce the residual charges by including a CTM in the protective layer but the abrasion resistance of the protective layer deteriorates.

(2) Improvement of Photosensitive Layer

JOP 2000-75521 discloses a photoreceptor including at least one of a chlorogarium phthalocyanine compound and a hydroxygarium phthalocyanine compound as a CGM and a CTM having a hydrazone skeleton. It is described in the publication that the combination of the specific CGM and CTM can diminish the transfer memory property and photo-memory property of the photoreceptor.

JOP 2000-105478 discloses a photoreceptor having a photosensitive layer including an azo pigment which is for use in an electrophotographic image forming apparatus using a laser diode emitting light with relatively short wavelength of from 380 to 500 nm as image writing light. It is considered that the azo pigments used therein have relatively weak photo-memory property compared to α-titanylphthalocyanine.

JOP 2001-305762 discloses a photoreceptor including a CGM and a CTM, wherein the CTM includes a first compound having a polarizability greater than 70 Å which is calculated by structure optimizing calculation using semiempirical molecular orbital calculation using PM3 parameter and having a dipole moment less than 1.8D which is calculated by the structure optimizing calculation, and a second compound having 50% transmittance at a longer wavelength than the first compound. It is described therein that the second compound absorbs extra light irradiating the photoreceptor, and thereby the photo-memory property of the photoreceptor can be diminished.

(3) Improvement of CTL

JOP 7-92701 discloses a multi-layered photoreceptor in which an oxytitanium phthalocaynine is included in the CGL and at least two kinds of CTMs are included in the CTL, wherein the difference in oxidation potential between the at least two kinds of CTMs is not greater than 0.04 V. It is considered that by using CTMs having almost the same energy level, hopping of the charge carriers between the CTMs can easily occur and the chance of trapping of charge carriers by the CTMs can be decreased, thereby decreasing the quantity of electrons excited by reverse charging performed by a transfer device, resulting in prevention of occurrence of the residual image problem.

JOP 08-152721 discloses a photoreceptor which is used for back-lighting type high speed image forming apparatus in which the exposure-development interval is from 10 to 150 msec, wherein the CTL of the photoreceptor has a charge mobility not less than $1\times10^{-6}$ $cm^2/V\cdot sec$ at an electric field of $2\times10^6$ V/cm. It is described therein that when a photoreceptor has a low dynamic photosensitivity, the latent image formation cannot be completed before the start of the developing operation and thereby the potential of the former image portions is increased after repeated use; but by using the technique mentioned above, the dynamic photosensitivity can be improved and thereby the residual image problem can be solved.

JOP 10-177262 discloses a photoreceptor which is for use in electrophotographic image forming apparatus having an intermediate transfer medium and which has a CGL including a phthalocyanine compound and a CTL including a compound selected from triphenylamine compounds and N,N,N',N'-tetraphenylbenzidine compounds. It is considered that the effect is produced by the combination of the specific compounds.

(4) Improvement of CGL

JOP 06-313972 discloses a photoreceptor in which the thickness of the CGL is increased so as to be not less than 25 μm or the content of a CGM in the CGL is increased so as to be not less than 50% by weight so that a number of charge carriers are trapped in the CGL, to make the resultant ghost image invisible.

JOP 10-69104 discloses a multi-layered photoreceptor having a CGL including a triarylamine compound having a xylyl group. It is described in the publication that a barrier to carrier transportation is formed at the interface between the CGL and CTL, and charge carriers are trapped thereby. Since the trapped carriers decrease the space electric field in the CGL, the potential of a half-tone image portion is not decreased, and thereby a residual image is formed at the portion. By including a CTM (i.e., a triarylamine compound having a xylyl group), the generated carriers are rapidly injected into the CTL and transported therethrough, and thereby accumulation of trapped carriers (i.e., occurrence of the residual image problem) can be prevented.

JOP 10-186696 discloses a photoreceptor having an electroconductive substrate and at least a photosensitive layer and a protective layer located overlying the substrate in this order, wherein the photosensitive layer includes oxytitaniumphthalocyanine having an CuKα X-ray diffraction spectrum in which strong peaks are observed at Bragg (2θ) angles of 9.5°, 24.1° and 27.3°. It is considered that the effect can be produced by the specific compound.

JOP 2002-107972 discloses a photoreceptor having a CGL including a hydroxygarium phthalocyanine compound and a butyral resin which serves as the binder resin and which has an acetal group, an acetyl group and a hydroxyl group, wherein the butyral resin has a butyralation degree not less than 62% by mole, a weight average molecular weight (Mw) not less than $2.0\times10^5$ and a number average molecular weight not less than $5.0\times10^4$. It is considered that the number of photo-carriers can be reduced by the specific polyvinyl butyral, and thereby occurrence of the residual image problem can be prevented.

(5) Improvement by Matching CGL with CTL

JOP 07-43920 discloses a multi-layered photoreceptor in which a specific azo pigment is used for the CGL and a CTM having a fluorenone skeleton is used for the CTL. It is considered that addition of the specific compounds prevents the photoreceptor from suffering light fatigue.

JOP 09-211876 discloses a negative polarity-type photoreceptor having a high γ property, in which a CGL including a phthalocyanine compound and a p-type CTL including a material selected from the group consisting of inorganic p-type semiconductors and particulate t-Se and charge transport polymers. It is described therein that the p-type CTL is characterized by including no positive hole transport material and thereby diffusion of a positive hole transport material into the CGL can be prevented. Therefore, trapping caused by the phthalocyanine pigment can be prevented and thereby the residual image-problem can be prevented.

(6) Improvement of Undercoat Layer

JOP 08-22136 discloses a photoreceptor having an undercoat layer including a silane coupling agent and an inorganic filler. It is described therein that by forming such an undercoat layer, charges to be flown to the substrate are smoothly flown to the substrate, and thereby occurrence of the residual image problem can be prevented.

In addition, JOP 11-184127 discloses a photoreceptor having an undercoat layer including a resin having a specific polyamide acid or polyamide acid ester structure or a polyimide structure, and a resin having a cyanoethyl group. It is considered that by using such resins, the photoreceptor is prevented from suffering light fatigue.

JOP 2000-112162 discloses a photoreceptor having an undercoat layer including a crosslinking resin which hardly changes its resistance even when the environmental humidity changes. It is described therein that JOP 08-146639 discloses an undercoat layer including a polycyclic quinone, perylene, etc.; JOP 10-73942 discloses an undercoat layer including a metallocene compound, an electron accepting compound and a melamine resin; JOP 08-22136 discloses an undercoat layer including a particulate metal oxide and a silane coupling agent; and JOP 09-258469 discloses an undercoat layer including a particulate metal oxide having a surface treated with a silane coupling agent.

It is described therein that in a high sensitive photoreceptor including oxytitaniumphthalocyanine in its CGL, a large number of molecules and carriers are excited, and therefore there are a large number of molecules which do not cause charge separation and in addition a large number of electrons and holes tend to remain in the photoreceptor in an electrophotographic process in which charging and light irradiating are repeated.

In attempting to solve the problem, the publication (JOP 2000-112162) proposes to use a combination of a polyamide resin and a zirconium compound or a combination of a polyamide resin, a zirconium alkoxide and a diketone compound such as acetyl acetone for the undercoat layer. In addition, JOP 2001-51438 proposes to use a combination of a cellulose resin, a zirconium compound, a zirconium alkoxide, and a diketone compound for the undercoat layer.

JOP 2001-305763 discloses a photoreceptor having an undercoat layer, and including a CGM and a CTM, wherein the CTM includes a material having a polarizability greater than 70 Å which is calculated by structure optimizing calculation using semiempirical molecular orbital calculation using PM3 parameter and having a dipole moment less than 1.8D which is calculated by the structure optimizing calculation, and a specific arylamine compound, wherein the undercoat layer includes a particulate titanium oxide treated with an organic silicon compound and a polyaminde having a specific diamine component as a constituent. It is considered that by forming such an undercoat layer, the carriers remaining in the photosensitive layer can be easily transported.

JOP 2002-107983 discloses a system in which the undercoat layer of the photoreceptor has a volume average resistivity of from $10^{10}$ to $10^{12}$ Ω·cm, the CTL thereof has a thickness not greater than 18 μm and the image forming apparatus does not include a discharger. It is considered that by not using a discharger, the photoreceptor is prevented from suffering light fatigue, and since the undercoat layer has a proper resistance, injection of charges from the substrate to the photosensitive layer can be suppressed, resulting in prevention of accumulation of space charges in the photoreceptor.

(7) Addition of Additives

JOP 10-177261 discloses a photoreceptor for use in an electrophotographic image forming apparatus having an intermediate transfer medium, wherein the photoreceptor has a CGL including a phthalocyanine compound and an outermost layer including a material having a hindered phenol structure. It is considered that the effect is produced by the specific material.

JOP 2000-292946 discloses a photoreceptor having a CGL including a phthalocyanine pigment and a dithiobenzyl compound. It is described therein that by using such materials, the photo-memory property of the photoreceptor can be diminished and thereby occurrence of the posi-ghost problem can be prevented.

(8) Improvement in Image Forming Method

JOP 07-13374 proposes a technique in that the photoreceptor used is sometimes charged reversely so as to have a reverse (positive) charge, and then allowed to settle.

In a photoreceptor having a high sensitive CTL, a large number of charge carriers are induced by light irradiation. In this case, electrons whose number is the same as that of the holes injected to the CTL are formed. If the electrons are not discharged to the substrate, the electrons remain in the CGL and thereby the residual image problem tends to occur. When such a photoreceptor is reversely (i.e., positively) charged, electrons are injected from the substrate and electron traps are formed in the CGL. When light irradiation is performed on such a photoreceptor, difference in the number of electron traps between the lighted portions and non-lighted portions is little, and thereby the ghost image becomes invisible.

JOP 07-44065 discloses a technique in that a DC voltage overlapped with an AC voltage is applied to the substrate of the photoreceptor. By applying a reverse bias to the substrate, electrons trapped in the CGL can be discharged therefrom. By overlapping an AC voltage, the electric current can be increased and thereby the reverse charge bias effect can be accelerated.

JOP 10-123802 discloses a technique in that charging (not main charging) is performed on the multi-layered photoreceptor having a CGL including a phthalocyanine compound and then light discharging is performed thereon, wherein the main charging is performed thereon if the predetermined portion of the photoreceptor reaches the main charging portion. It is described therein that by performing such an image forming method, the photoreceptor is charged after the space charges in the photoreceptor are released therefrom, and thereby occurrence of the residual image problem can be prevented.

JOP 10-123855 discloses a technique in that a controller is provided in an image forming apparatus, which controls the transfer current flowing from a transfer device to the multi-layered photoreceptor used, wherein the photoreceptor has a CGL including a phthalocyanine compound. It is described therein that the greater the transfer current, the more conspicuously a negative residual image is formed. The reason is considered as follows. When an image is transferred, holes are injected into non-lighted portions of the photoreceptor and the holes are trapped at the interface of the CGL or the CTL on the substrate side. The trapped holes are released in the next charging process, and thereby the dark decay is enhanced (i.e., apparent sensitization), resulting in occurrence of formation of a negative residual image. Therefore, by controlling the transfer current, the number of charge carriers injected into the photoreceptor can also be controlled and occurrence of the residual image problem can be prevented.

JOP 2000-231246 proposes a technique in that the wavelength of the image writing light and the discharging light are determined depending on the ratio of photo-memory property before charging to the photosensitivity of the photoreceptor.

JOP 10-123856 proposes a technique in that light irradiation is performed on a photoreceptor having a CGL including a phthalocyanine compound before the transfer process to decrease the potential of the non-lighted portion to ⅓ of the potential, in order to prevent occurrence of the residual image problem. It is considered that by performing such irradiation, the difference in potential between the lighted portion and the non-lighted portion decreases and thereby the residual image becomes invisible.

JOP 10-246997 discloses a technique in that in an image forming apparatus using a photoreceptor having a photosensitive layer and a protective layer including a light-curable acrylic resin, a humidity sensor is provided in a vicinity of the photoreceptor to change the current of the AC component of the voltage applied by the charger depending on the humidity. It is described therein that by using such a technique, chance of formation of blurred images can be decreased. In addition, it is described therein that the photo-memory property of the photoreceptor is weakened using the technique, but the mechanism thereof is not described therein.

JOP 2001-117244 discloses a technique in that in order to prevent formation of ghost images when a S-form photoreceptor is used, the period of half-decay of the potential on the photoreceptor in light irradiation, which period is determined using a Xerographic Time Of Flight (TOF) method, is controlled so as to be not greater than 1/10 of the exposure-development interval between the light irradiation process and the following development process.

As described in numbered paragraph (6) above, JOP 2002-107983 discloses a technique in that by not using a discharger, the photoreceptor is prevented from suffering light fatigue.

JOP 2002-123067 discloses a technique in that the photoreceptor and charging conditions are controlled so as to satisfy the following relationship:

$$|(V1-V2)/VH|<0.020$$

wherein VH represents the potential of the charged photoreceptor; V1 represents the potential of the photoreceptor after a dark decay for a time of 10T, wherein T represents the charge-exposure interval; and V2 represents the potential of the photoreceptor after a dark decay for a time of 10 T, which photoreceptor is charged again after one cycle of charging followed by light irradiation has been completed.

Specifically, a technique is described therein that the process speed is increased or the photoreceptor is charged so as to have a relatively low potential.

As a result of the present inventor's experiments in which these photoreceptors and techniques are evaluated, it is found that the photoreceptors cannot be satisfactorily used as a photoreceptor which has good durability and can produce high quality images at a high speed, and by using the techniques, the resultant image forming apparatus cannot be satisfactorily used as an apparatus which can produce high quality images at a high speed.

In addition, it is discovered that when a protective layer is formed on a commercialized photoreceptor which does not cause the residual image problem, the resultant photoreceptor causes the residual image problem. Therefore the cause for the problem lies in the protective layer.

Accordingly, it is considered that even if the techniques mentioned above in numbered paragraphs (2) to (7) are applied to a photoreceptor having a protective layer, the residual image improving effect is little. In addition, if the technique mentioned above in numbered paragraph (8) is applied, the resultant image forming apparatus has one or more of the following drawbacks:

(A) all the image qualities are not high;

(B) the image forming apparatus becomes large in size; and (C) the print costs increase.

Namely, the apparatus cannot fulfill the user's needs, and therefore the apparatus cannot be commercialized.

Further, the techniques mentioned above in numbered paragraph (1) relate to photoreceptors having no protective layer, and therefore even when the techniques are applied to photoreceptors having a protective layer, the expected effect cannot be produced. When these techniques are applied, there is a case where the effect can be hardly produced depending on the thickness of the outermost layer or the like factors of the photoreceptor. In addition, there is a case where the effects produced by forming a protective layer (such as impartment of high durability, good cleanability and good transferability) wear off when such techniques are applied.

Thus, the residual image problem cannot be fully solved.

Because of these reasons, a need exists for an electrophotographic photoreceptor which can produce high quality images at a high speed without causing the residual image problem and which has good durability, good cleanability and good transferability.

SUMMARY OF THE INVENTION

Accordingly, an object of the present invention is to provide a photoreceptor which can produce high quality images at a high speed without causing the residual image problem and which has good durability, good cleanability and good transferability.

Another object of the present invention is to provide a method for manufacturing the photoreceptor.

Yet another object of the present invention is to provide an image forming apparatus and a process cartridge which can produce high quality images at a high speed without causing the residual image problem and without frequently changing the photoreceptor.

Briefly these objects and other objects of the present invention as hereinafter will become more readily apparent can be attained by a photoreceptor which includes an electroconductive substrate, and at least a photosensitive layer located overlying the substrate and a protective layer located overlying the photosensitive layer, wherein the photoreceptor has a property such that when the photoreceptor is charged so as to have a potential of −700 V and then exposed to light with exposure of 0.4 $\mu J/cm^2$, the potential ($P_L$) of a lighted portion of the photoreceptor decreases at a rate not greater than 700 V/sec during a time period of from a time 35 msec after the exposure to a transition time of the photoreceptor. The transition time is defined as a time at which the slope of the charge decay curve of the photoreceptor changes as illustrated in FIG. 13.

The protective layer preferably includes a CTM. The CTM is preferably a charge transport polymer and more preferably a charge transport polymer having a triarylamine skeleton.

The photosensitive layer preferably includes a charge generation layer and a charge transport layer, which are overlaid. In addition, it is preferable that the charge transport layer has a charge mobility ($\mu$) not less than $1.2\times10^{-5}$ $cm^2/V\cdot sec$ at an electric field strength of $4\times10^5$ V/cm, wherein dependence ($\beta$) of the charge mobility on the electric field strength (E) is not greater than $1.6\times10^{-3}$, wherein $\beta=\log \mu/E^{1/2}$.

As another aspect of the present invention, a method for manufacturing the photoreceptor mentioned above, which includes the step of spray-coating a protective layer coating liquid including a solvent, which dissolves a resin included in the photosensitive layer, on the photosensitive layer, wherein the following relationship is satisfied:

$$1.3<W1/W2<1.9$$

wherein W1 represents the weight of the protective layer, which is measured after coating the protective layer coating liquid and allowing the coated liquid to settle for 1 hour under conditions of 25±3° C. and 53±5% RH; and W2 represents the weight of the protective layer, which is measured after coating the protective layer coating liquid and drying the coated liquid upon application of heat thereto, specifically, by heating at a temperature not lower than the boiling point of the solvent included in the coating liquid for 10 minutes or more).

As yet another aspect of the present invention, an image forming apparatus is provided which includes a photoreceptor, a charger configured to charge the photoreceptor, an imagewise light irradiator configured to irradiate the photoreceptor with imagewise light to form an electrostatic latent image thereon, an image developer configured to develop the electrostatic latent image with a toner to form a toner image thereon, and a transfer device configured to transfer the toner image on a receiving material optionally via an intermediate transfer medium, wherein the exposure-development interval between light irradiation and development of a latent image is not greater than 100 ms, wherein the photoreceptor includes an electroconductive substrate, and at least a photosensitive layer located overlying the substrate and a protective layer located overlying the photosensitive layer, and wherein the photoreceptor has a property such that the potential ($V_L$) of a lighted portion of the photoreceptor changes at a rate not greater than 700 V/sec after a time 35 milliseconds after the light irradiation to the transition time of the photoreceptor during the exposure-development interval between the light irradiation and the development. The transition time is preferably not greater than the exposure-development interval.

As a further aspect of the present invention, a process cartridge is provided which includes the photoreceptor of the present invention and at least one of a charger, a light irradiator, a n image developer, a transfer device, a cleaner and a discharger.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present inventor discovers that photoreceptors having a protective layer often cause the residual image problem but when images are formed on the photoreceptors at a low speed, the photoreceptors do not cause the residual image problem. Namely, it is discovered that whether the residual image problem is caused depends on the potential decaying property of photoreceptors.

Figure 13:
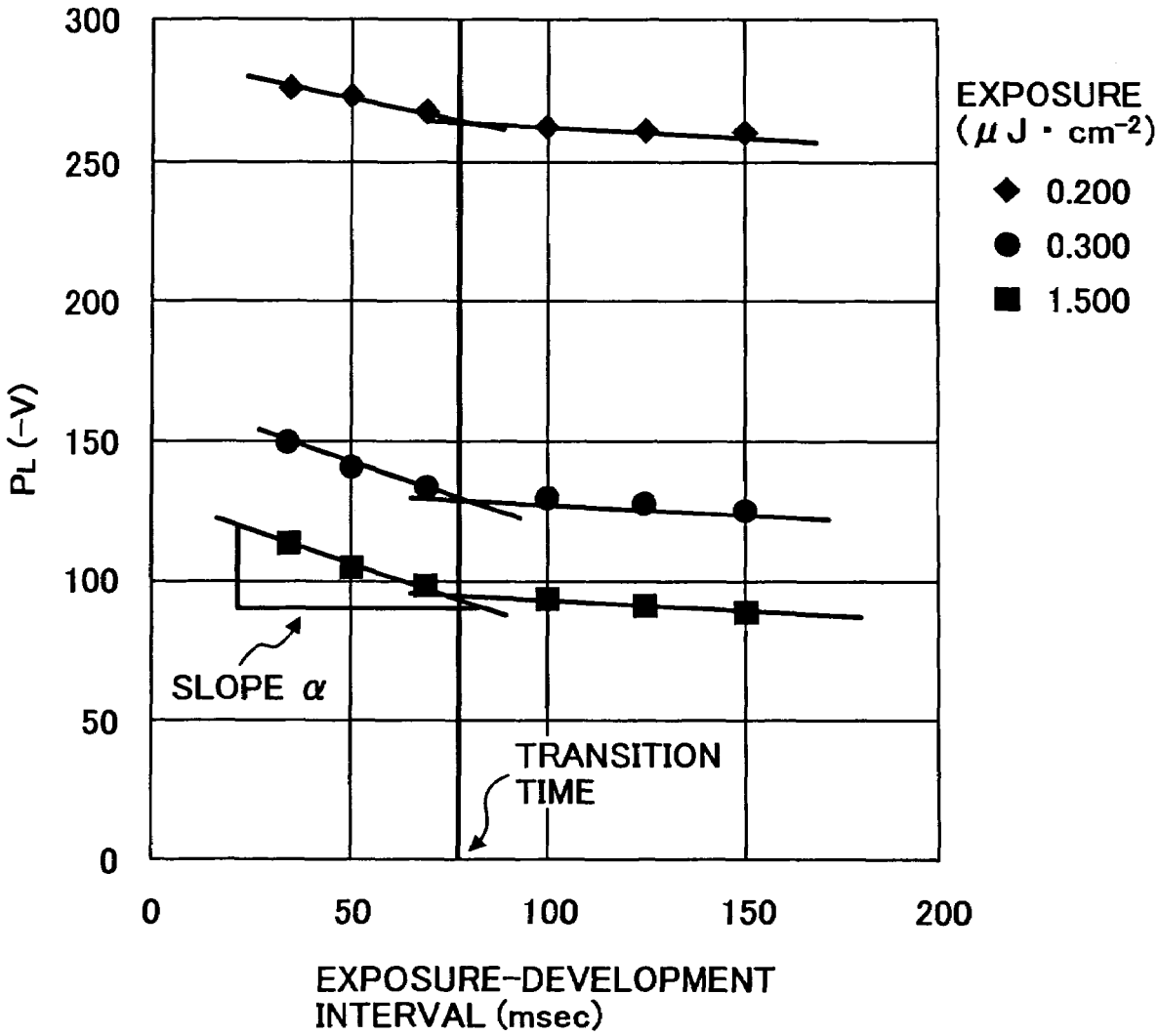
FIG. 13 is a graph for explaining the charge decay property of a photoreceptor and the transition time when the photoreceptor is exposed to light.
Figure 14:
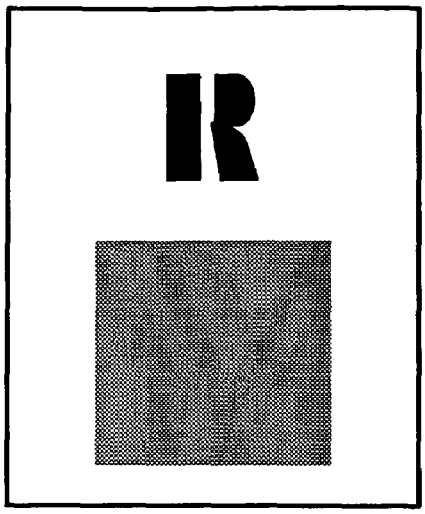
FIGS. 14 to 16 are schematic views for explaining the residual image problem.
Figure 15:
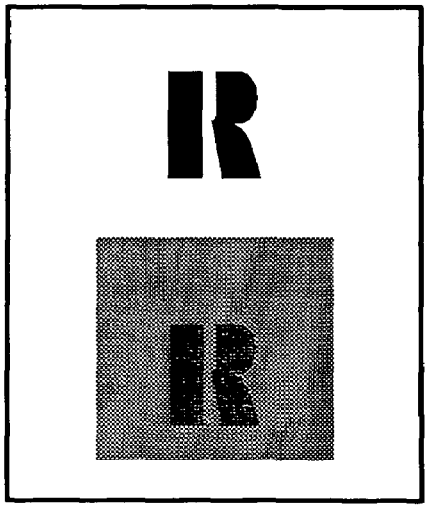
Figure 16:
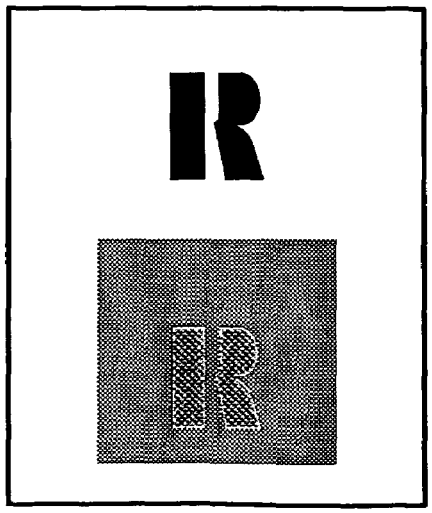
Figure 17A:
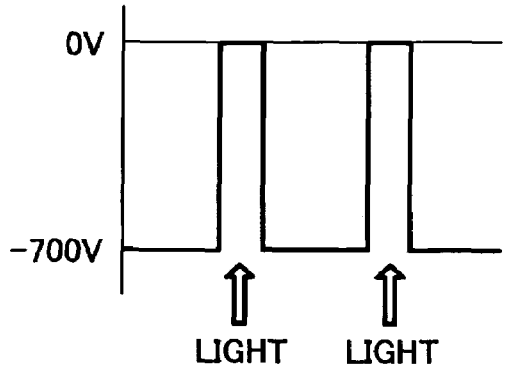
FIGS. 17A to 17C are schematic views for explaining change of the potential of a photoreceptor during image forming processes.
Figure 17B:
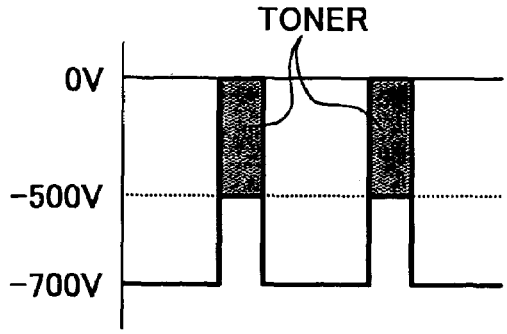
Figure 17C:
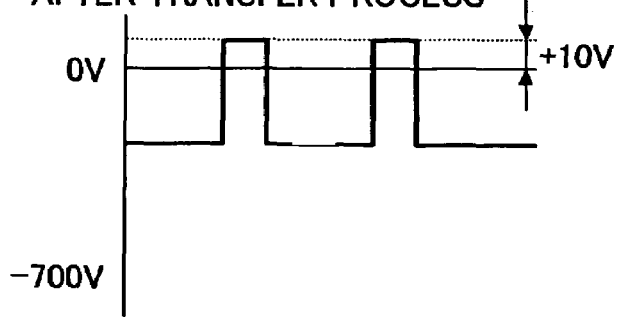

When the exposure-development interval between light irradiation and development is shortened, the potential ($P_L$) of lighted portions of general organic photoreceptors increases to some extent when the lighted portions are developed. As illustrated in FIG. 13, the potential of the lighted portion linearly decreases with time after a time 35 msec after the light irradiation, and the slope of the potential decay linear curve changes at a transition time. As can be understood from the potential decay linear curve, the slope at a time before the transition time (hereinafter a short time side) is more sharp than that after the transition time (hereinafter a long time side). In other words, when the exposure-development interval is shortened at the short time side, the potential $P_L$ at the development rapidly increases. It is considered that the leading group of the charges which are generated by light irradiation and which move due to the electric field reach the surface of the photosensitive layer at the transition time.

The present inventor discovers that whether a photoreceptor causes the residual image problem depends on the charge decay property of a photoreceptor. Specifically, it is discovered that when the slope of the potential decay linear curve is not greater than a specific value (i.e., 700 V/sec), occurrence of the residual image problem can be prevented.

In addition, it is discovered that when a protective layer is formed on a photosensitive layer while the photosensitive layer is not dissolved by the protective layer coating liquid (i.e., when a barrier is formed between the photosensitive layer and the protective layer), charges tend stay at the interface therebetween. Therefore, it is discovered that by coating a protective layer coating liquid on a photosensitive layer while dissolving the photosensitive layer to a predetermined extent, occurrence of the residual image problem can be prevented.

The present invention is made from this knowledge.

Then the potential decay property will be explained.

Methods for evaluating the potential decay property of a photoreceptor have been disclosed, for example, in JOPs 10-115944 and 2001-312077. Namely, in the methods, the potential decay property of a film of a CTM or a film of a resin and a CTM is estimated by a Time Of Flight (TOF) method. These methods are useful when photoreceptors are designed. However, in practical image forming apparatus, the strength of the electric field formed on the film of the photoreceptor changes with time after a light irradiation process, but in the TOF method the electric field strength in the film of the photosensitive layer is considered to be constant. In addition, the TOF method does not consider the influence of the charges injected from a CGL to a CTL on charge transporting.

A method in which the response of a photoreceptor is directly evaluated is disclosed in, for example, JOP 2000-305289. In the method, change of potential of a photoreceptor after light irradiation is recorded using a high speed surface potential meter to determine the time needed for the photoreceptor to have a predetermined potential. This method is called "Xerographic Time Of Flight (XTOF) method". By using this method, the drawbacks of the TOF method are remedied. However, the light source used for this method is different from that used for the light irradiators of practical image forming apparatus. Therefore, the method is not necessarily a direct measuring method.

Figure 12:
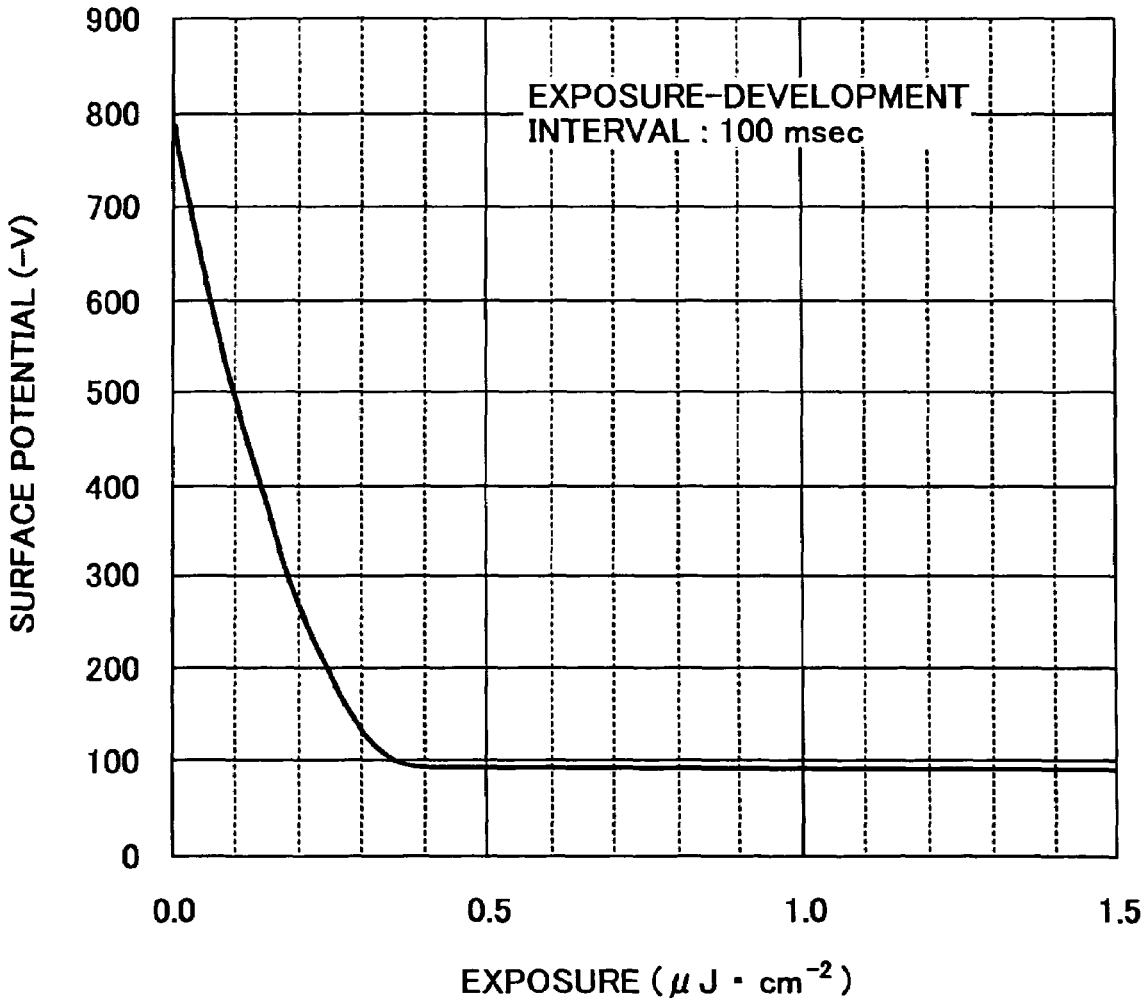
FIG. 12 is a graph for explaining a charge decay curve of a photoreceptor when the photoreceptor is exposed to light.

JOP 2000-275872 discloses an apparatus for evaluating a photoreceptor. By using this apparatus, it becomes possible to determine the relationship between the potential of a lighted portion and time (i.e., light-decay curve) during the exposure-development interval (Ted) after the photoreceptor is exposed to light emitted by a laser diode (LD). The light-decay curve of a photoreceptor is illustrated in FIG. 12.

When the potential ($P_L$) of a lighted portion is plotted while the interval Ted is changed, a transition time at which the slope of the charge decay curve changes can be found. By using this method, the charge decay curve of a photoreceptor can be precisely determined.

When relationship between the charge decay property of photoreceptors and image qualities such as evenness of image density and occurrence of residual images is examined using this evaluation method, the following can be found:

(1) The residual image problem is caused when the interval Ted is shorter than the transition time. In particular, when the image forming apparatus does not use a discharger, the tendency is strong.

(2) By gentling the slope of the charge decay curve on a short time side (i.e., at a time shorter than the transition time), occurrence of the residual image problem can be prevented.

(3) When the slope a of the charge decay curve from a time 35 msec after the exposure to the transition time, which is illustrated in FIG. 13, is not greater than 700 V/sec, occurrence of the residual image problem can be prevented.

(4) In order to gentle the slope, it is effective to include a CTM in the protective layer.

Even when a CTM is not included in the protective layer coating liquid, it is possible to include a CTM in the protective layer by coating the protective layer coating liquid while dissolving the underlying photosensitive layer including a CTM (i.e., by coating the coating liquid such that no interface is formed between the photosensitive layer and the protective layer).

From the above-mentioned knowledge, the photoreceptor and the image forming apparatus of the present invention, which can produce high quality images without causing the residual image problem, can be provided.

The image forming apparatus of the present invention will be explained referring to drawings.

Figure 1:
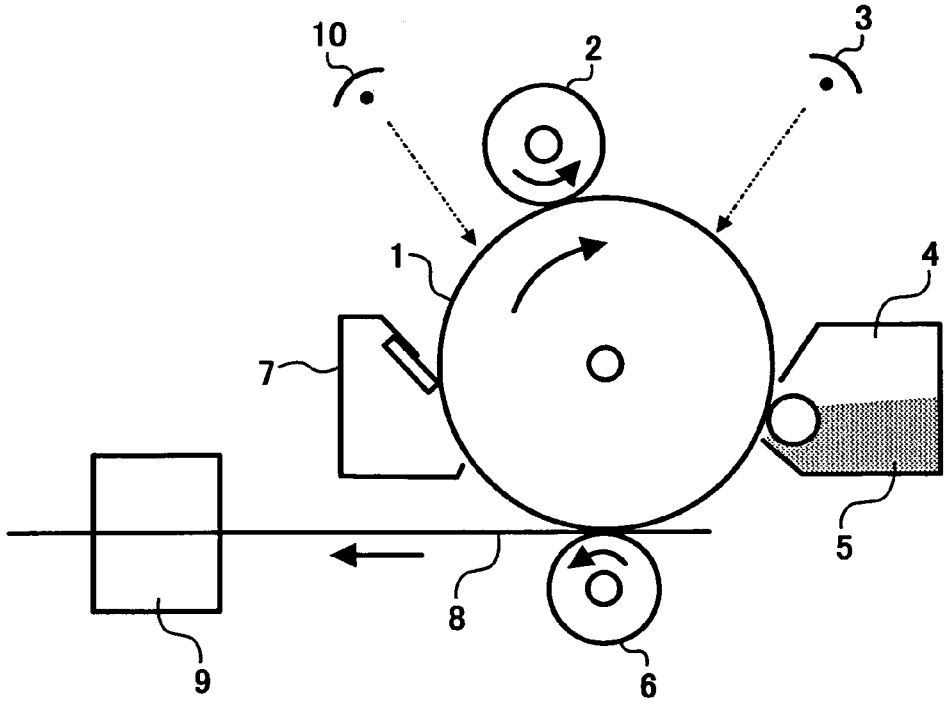
FIGS. 1 to 6 are schematic views illustrating embodiments of the image forming apparatus of the present invention.

FIG. 1 is a schematic view illustrating an embodiment of the electrophotographic image forming apparatus of the present invention. The below-mentioned modified versions can also be included in the scope of the present invention.

In FIG. 1, numeral 1 denotes a photoreceptor. The photoreceptor 1 is the photoreceptor of the present invention which includes at least a photosensitive layer located overlying an electroconductive substrate and a protective layer located overlying the photosensitive layer, wherein the photoreceptor has a property such that when the photoreceptor is charged so as to have a potential of −700 V and then exposed to light with exposure of 0.4 μJ/cm$^2$, the potential ($P_L$) of a lighted portion of the photoreceptor decreases at a rate not greater than 700 V/sec during a time period of from a time 35 msec after the exposure to a transition time of the photoreceptor.

The photoreceptor 1 has a drum form, but photoreceptors having a form such as sheet-form and endless belt-form can also be used.

Around the photoreceptor 1, a discharging lamp 10 to decrease charges remaining on the photoreceptor 1, a charger 2 configured to charge the photoreceptor 1, an imagewise light irradiator 3 configured to irradiate the photoreceptor 1 with imagewise light to form an electrostatic latent image on the photoreceptor 1, an image developer 4 configured to develop the latent image with a toner 5 to form a toner image on the photoreceptor 1, and a cleaning unit 7 including a cleaning blade configured to clean the surface of the photoreceptor 1 are arranged while contacting or being set closely to the photoreceptor 1. The toner image formed on the photoreceptor 1 is transferred on a receiving paper 8 by a transfer device 6. The toner image on the receiving paper 8 is fixed thereon by a fixer 9.

As the charger 2, any known chargers such as corotrons, scorotrons, solid state chargers, and roller chargers can be used. Among the chargers, contact chargers and short-range chargers are preferably used because of consuming low power. In particularly, short-range chargers which charges a photoreceptor while a proper gap is formed between the chargers and the surface of the photoreceptor are more preferably used.

As the transfer device 6, the above-mentioned known chargers can be used. Among the chargers, a combination of a transfer charger and a separating charger is preferably used.

Suitable light sources for use in the imagewise light irradiator 3 and the discharging lamp 10 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

When the toner image formed on the photoreceptor 1 by the image developer 4 is transferred onto the receiving paper 8, all of the toner image are not transferred on the receiving paper 8, and toner particles remain on the surface of the photoreceptor 1. The residual toner is removed from the photoreceptor 1 by the cleaner 7. Suitable cleaners for use as the cleaner 7 include cleaning blades made of a rubber, fur blushes and mag-fur blushes.

When the photoreceptor 1 which is previously charged positively (or negatively) is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 2:
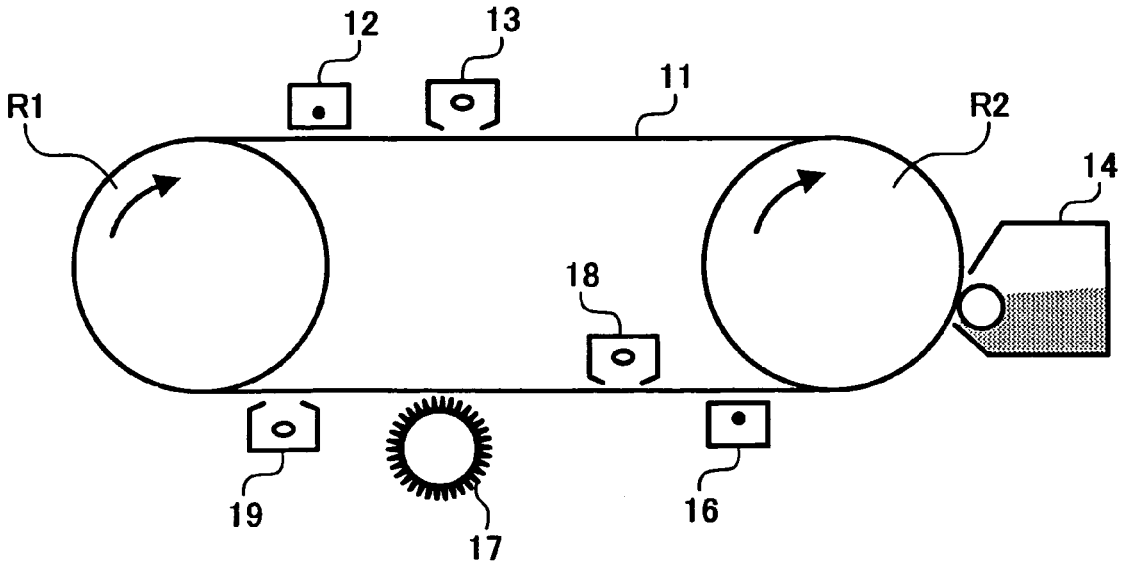

FIG. 2 is a schematic view illustrating another-embodiment of the image forming apparatus of the present invention. In this embodiment, a belt-form photoreceptor 11 is used. The photoreceptor 11 is the photoreceptor of the present invention.

The belt-form photoreceptor 11 is rotated by rollers R1 and R2. The photoreceptor 11 is charged with a charger 12, and then exposed to imagewise light emitted by an imagewise light irradiator 13 to form an electrostatic latent image on the photoreceptor 11. The latent image is developed with an image developer 14 to form a toner image on the photoreceptor 11. The toner image is transferred onto a receiving paper (not shown) using a transfer device 16. After the toner image transferring process, the surface of the photoreceptor 11 is cleaned with a cleaning brush 17 after performing a pre-cleaning light irradiating operation using a pre-cleaning light irradiator 18. Then the photoreceptor 11 is exposed to light emitted by a discharging light source 19 to reduce the charge remaining thereon. In the pre-cleaning light irradiating process, light irradiates the photoreceptor 11 from the side of the substrate thereof. In this case, the substrate has to be light-transmissive.

The image forming apparatus of the present invention is not limited to the image forming units as shown in FIGS. 1 and 2. For example, in FIG. 2, the pre-cleaning light irradiating operation can be performed from the photosensitive layer side of the photoreceptor 11. In addition, the light irradiation in the imagewise light irradiating process and the discharging process may be performed from the substrate side of the photoreceptor 11.

Further, a pre-transfer light irradiation operation, which is performed before transferring the toner image, and a preliminary light irradiation operation, which is performed before the imagewise light irradiation, and other light irradiation operations may also be performed.

The above-mentioned image forming unit may be fixedly set in image forming apparatus such as copiers, facsimiles and printers. However, the image forming unit may be set therein as a process cartridge. The process cartridge means an image forming unit which includes a photoreceptor and at least one or more of a charger, an imagewise light irradiator, an image developer, a transfer device, a cleaner, and a discharger.

Various types of process cartridges can be used in the present invention. An embodiment of the process cartridge of the present invention is illustrated in FIG. 3.

Figure 3:
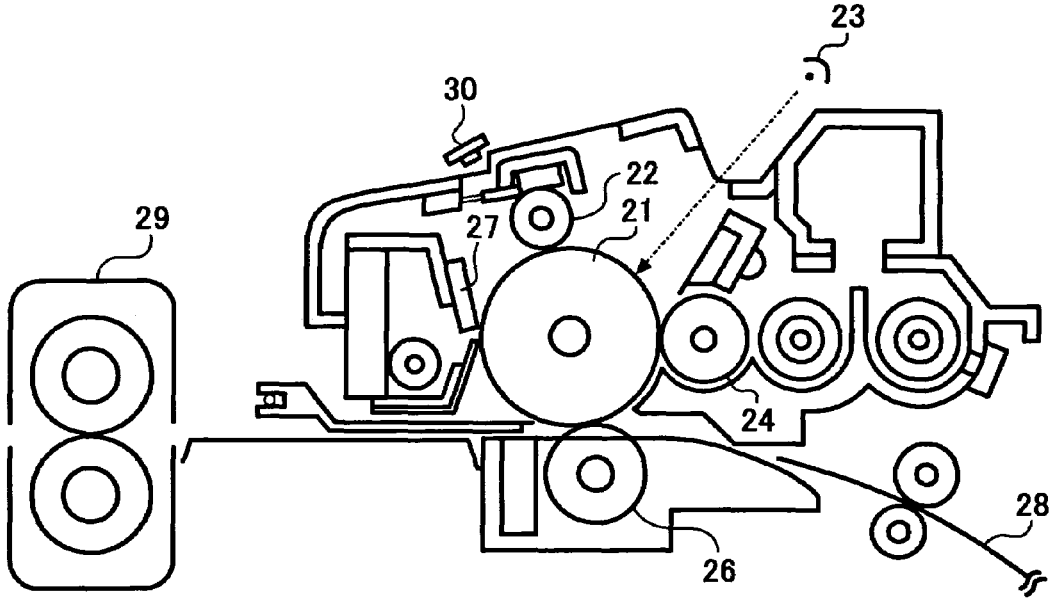

In FIG. 3, the process cartridge includes a photoreceptor 21, which is the photoreceptor of the present invention, a charger 22 configured to charge the photoreceptor 21, an image developer (a developing roller) 24 configured to develop an electrostatic latent image, which is formed on the photoreceptor by an imagewise light irradiator 23, with a toner to form a toner image, a transfer device 26 configured to transfer the toner image to a receiving material 28, and a cleaning blade 27 configured to clean the surface of the photoreceptor 21. Numerals 29 and 30 denote a fixer and a discharger, respectively. The photoreceptor 21 has a drum form, but photoreceptors have a form such as sheet-form and endless belt-form can also be used.

Figure 4:
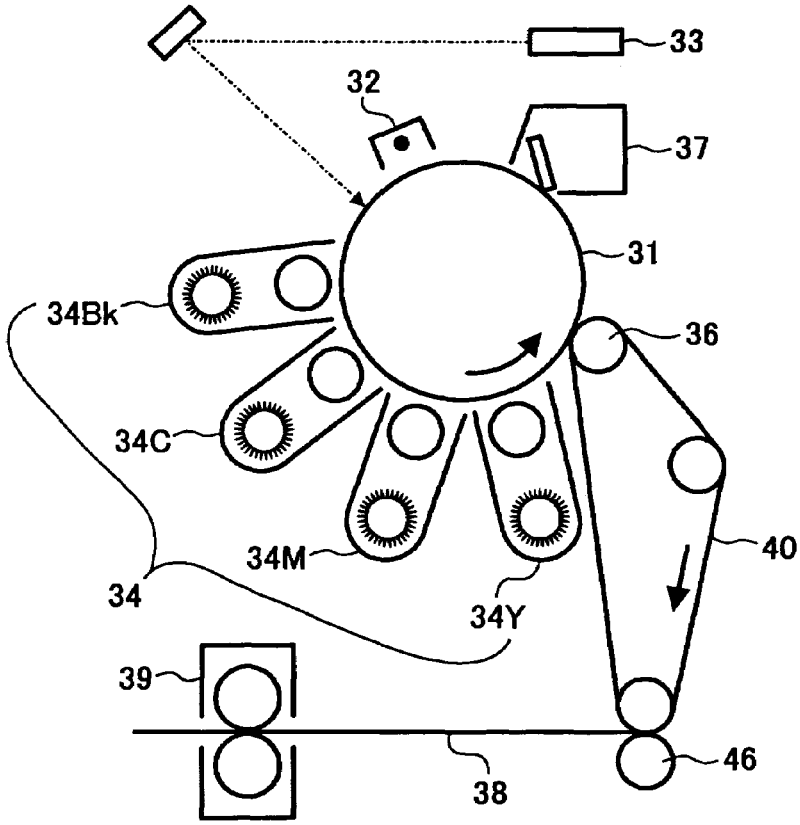

FIG. 4 illustrates another embodiment of the image forming apparatus of the present invention. Referring to FIG. 4, the image forming apparatus has a photoreceptor 31 which is the photoreceptor of the present invention. Around the photoreceptor 31, a charger 32, an imagewise light irradiator 33, an image developing unit 34 having a black image developer 34Bk, a cyan image developer 34C, a magenta image developer 34M and a yellow image developer 34Y, an intermediate transfer belt 40 serving as an intermediate transfer medium, and a cleaner 37 are arranged.

The image developers 34Bk, 34C, 34M and 34Y can be independently controlled, and each of the image developers is independently driven when desired. Toner images formed on the photoreceptor 31 are transferred onto the intermediate transfer belt 40 by a first transfer device 36. The intermediate transfer belt 40 is brought into contact with the photoreceptor 31 by the first transfer device 36 only when a toner image on the photoreceptor 31 is transferred thereto. The toner images overlaid on the intermediate transfer belt 40 are transferred onto a receiving material 38 by a second transfer device 46, and the toner images are fixed on the receiving material 38 by a fixer 39. The second transfer device 46 is brought into contact with the intermediate transfer belt 40 only when the transfer operation is performed.

In an image forming apparatus having a drum-form transfer device, color toner images are transferred onto a receiving material electrostatically attached to the transfer drum. Therefore, an image cannot be formed on a thick paper. However, in the image forming apparatus as illustrated in FIG. 4, each toner image is formed on the intermediate transfer belt and the overlaid toner images are transferred onto a receiving material. Therefore, an image can be formed on any kinds of receiving materials. The image forming method using an intermediate transfer medium can be applied to the image forming apparatus as illustrated in FIGS. 1-3, and 5 as well as the image forming apparatus illustrated in FIGS. 4 and 6.

Figure 5:
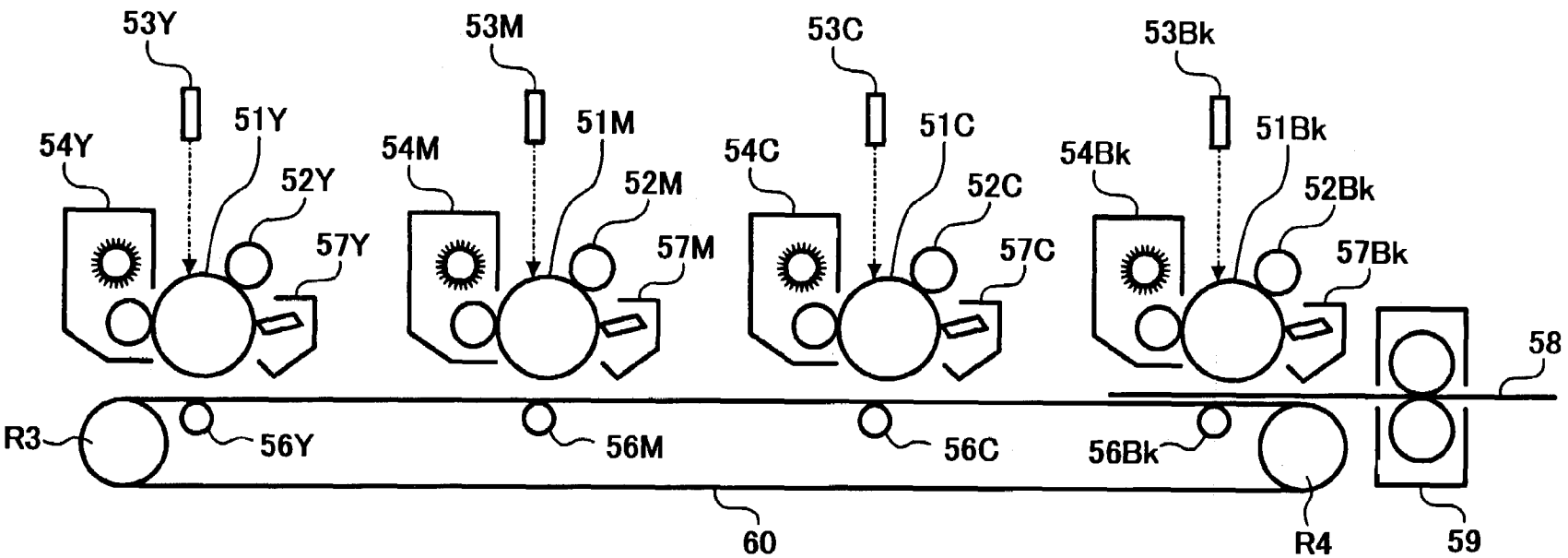

FIG. 5 illustrates another embodiment of the image forming apparatus of the present invention.

The image forming apparatus has four color image forming sections, i.e., yellow, magenta, cyan and black image forming sections. The image forming sections include respective photoreceptors 51Y, 51M, 51C and 51Bk, which are the photoreceptor of the present invention.

Around each of the photoreceptors (51Y, 51M, 51C or 51Bk), a charger (52Y, 52M, 52C or 52Bk), an imagewise light irradiator (53Y, 53M, 53C or 53Bk), an image developer (54Y, 54M, 54C or 54Bk), and a cleaner (57Y, 57M, 57C or 57Bk) are arranged. In addition, a feed/transfer belt 60, which is arranged below the image forming sections, is tightly stretched by rollers R3 and R4. The feed/transfer belt 60 is attached to or detached from the photoreceptors by transfer devices 56Y, 56M, 56C and 56Bk to transfer toner images from the photoreceptors to a receiving material 58. The resultant color toner image is fixed by a fixer 59.

The tandem-type image forming apparatus illustrated in FIG. 5 has a plurality of photoreceptors for forming four color images, and color toner images which can be formed in parallel can be transferred onto the receiving material 58. Therefore, the image forming apparatus can form full color images at a much higher speed than that of such an image forming apparatus as illustrated in FIG. 4.

Figure 6:
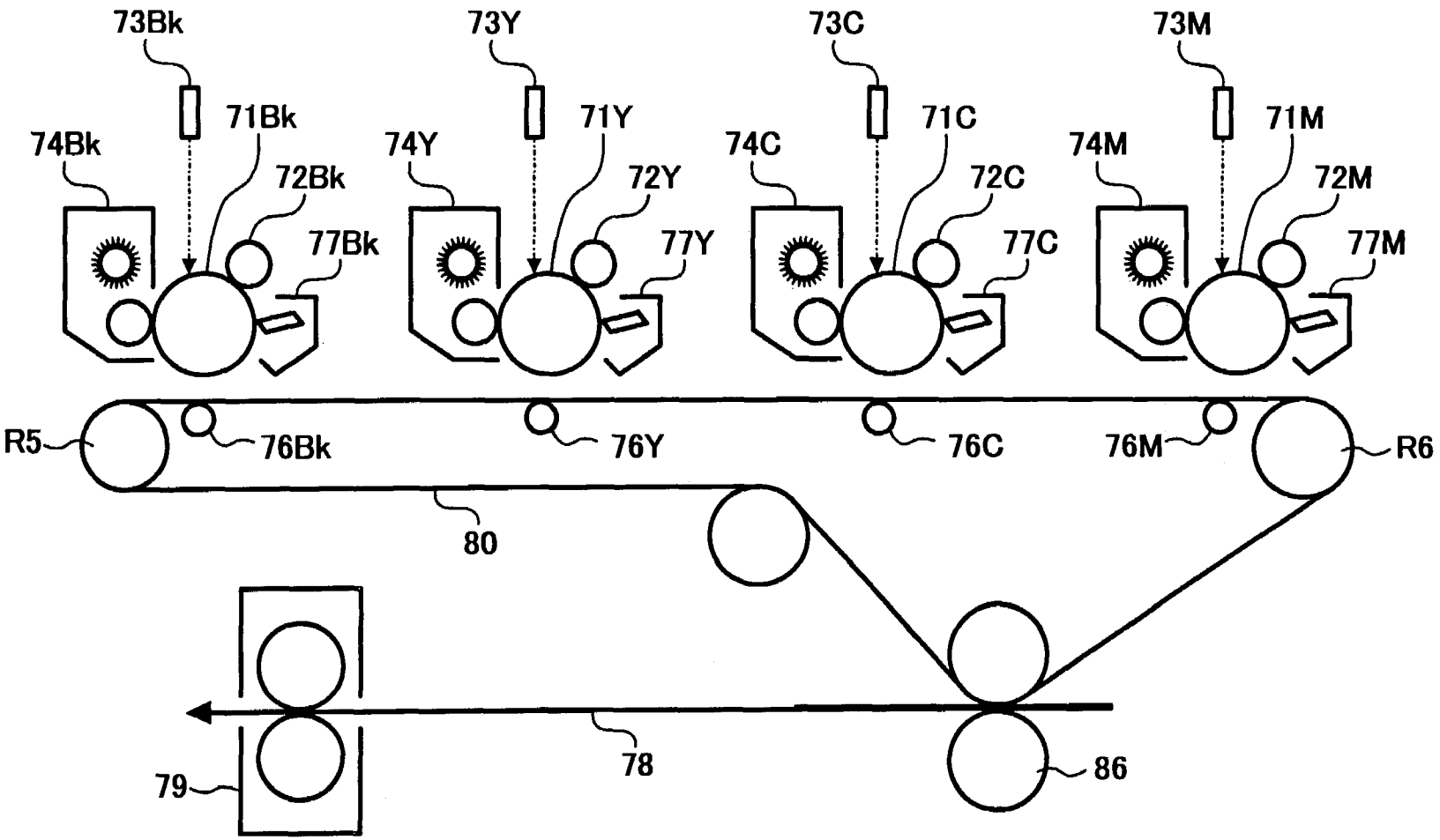

FIG. 6 illustrates another embodiment of the image forming apparatus of the present invention, which is a tandem-type color image forming apparatus having an intermediate transfer medium.

The image forming apparatus has four color image forming sections, i.e., yellow, magenta, cyan and black image forming sections. The image forming sections include respective photoreceptors 71Y, 71M, 71C and 72Bk, which are the photoreceptor of the present invention.

Around each of the photoreceptors (71Y, 71M, 71C or 71Bk), a charger (72Y, 72M, 72C or 72Bk), an imagewise light irradiator (73Y, 73M, 73C or 73Bk), an image developer (74Y, 74M, 74C or 74Bk), and a cleaner (77Y, 77M, 77C or 77Bk) are arranged. In addition, an intermediate transfer belt 80, which is arranged below the image forming sections, is tightly stretched by rollers R5 and R6 and other rollers. The intermediate transfer belt 80 is attached to or detached from the photoreceptors by transfer devices 76Y, 76M, 76C and 76Bk to receive toner images from the photoreceptors. The color toner images formed on the intermediate transfer belt 80 are transferred onto a receiving material 78 at once by a transfer device 86. Then the color toner images are fixed by a fixer 79.

Next, the organic photoreceptor of the present invention will be explained in detail referring to drawings.

Figure 7:
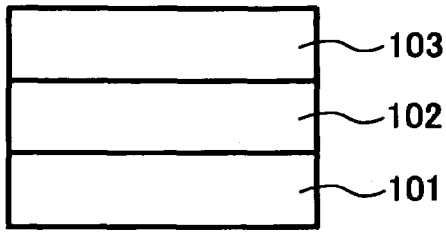
FIGS. 7 to 10 are schematic view illustrating the cross sections of embodiments of the photoreceptor of the present invention.

FIG. 7 illustrates a schematic cross section of an embodiment of the photoreceptor of the present invention. The photoreceptor has an electroconductive substrate 101, a photosensitive layer 102 and a protective layer 103.

Figure 8:
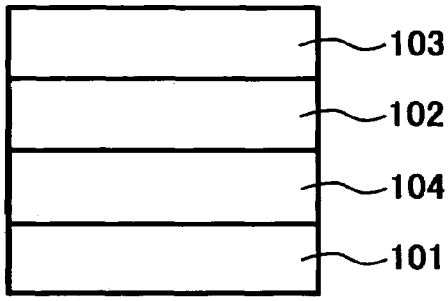

FIG. 8 illustrates a schematic cross section of another embodiment of the photoreceptor of the present invention. The photoreceptor has an electroconductive substrate 101, an undercoat layer 104, a photosensitive layer 102 and a protective layer 103.

Figure 9:
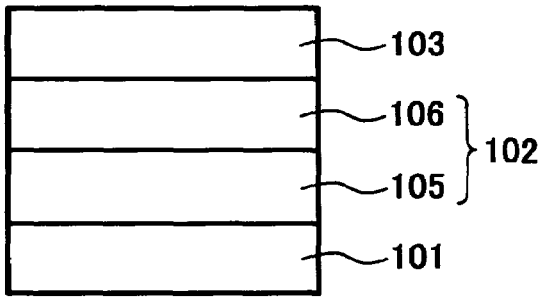

FIG. 9 illustrates a schematic cross section of another embodiment of the photoreceptor of the present invention. The photoreceptor is a functionally-separated photoreceptor and has a CGL 105 and a CTL 106 as the photosensitive layer 102.

Figure 10:
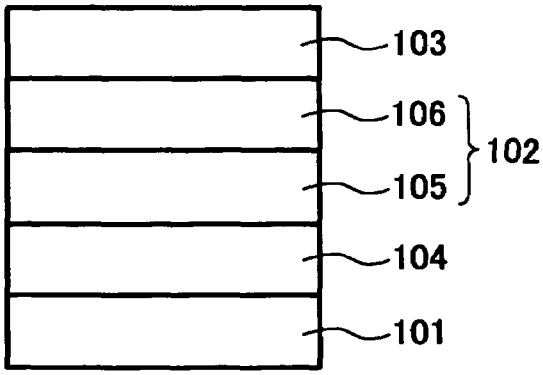

FIG. 10 illustrates a schematic cross section of another embodiment of the photoreceptor of the present invention. The photoreceptor has a structure such that an undercoat layer is formed between the substrate 101 and the CGL 105 of the photoreceptor illustrated in FIG. 9.

Suitable materials for use as the electroconductive substrate 101 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, iron and the like, or a metal oxide such as tin oxides, indium oxides and the like, is formed by a method such as vapor deposition and sputtering. In addition, a plate of a metal such as aluminum, aluminum alloys, nickel and stainless steel can be used. A metal cylinder can also be used as the substrate 101, which is prepared by tubing a metal such as aluminum, aluminum alloys, nickel and stainless steel by a method such as drawing ironing, impact ironing, extruded ironing, extruded drawing or cutting, and then subjecting the surface of the tube to cutting, super finishing, polishing and the like treatments.

Next, the photosensitive layer of the photoreceptor of the present invention will be explained.

In the photoreceptor of the present invention, the photosensitive layer 102 may be a mixture type photosensitive layer in which both a CGM and a CTM are dispersed, or a multi-layered photosensitive layer having a CGL and a CTL.

At first, the multi-layered photosensitive layer including the CGL 105 and the CTL 106 will be explained.

The CGL 105 includes a CGM as a main component, and optionally includes a binder resin. For the CGL 105, known CGMs such as inorganic CGMs and organic CGMs can be used. Specific examples of the inorganic CGMs include crystalline selenium, amorphous selenium, selenium-tellurium, selenium-tellurium-halogen, selenium-arsenic compound, amorphous silicon, etc. In addition, amorphous silicon in which a dangling bond is terminated with a hydrogen atom or a halogen atom or in which a boron atom, a phosphorous atom is doped can be preferably used.

Specific examples of the organic CGMs include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments; anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, benzimidazole pigments, and the like organic pigments.

These CGMs can be used alone or in combination.

Suitable binder resins, which are optionally included in the CGL, include polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, polyacrylamide, and the like resins.

These resins can be used alone or in combination.

In addition, charge transport polymers can be used as the binder resin of the CGL. Further, low molecular weight CTMs can be added to the CGL if desired.

CTMs are classified into positive-hole transport materials and electron transport materials. In addition, CTMs can also be classified into low molecular weight CTMs and charge transport polymers.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, and the like.

These electron transport materials can be used alone or in combination.

Specific examples of the positive-hole transport materials include oxazole derivatives, oxadiazole derivatives, imidazole derivatives, triphenyl amine derivatives, 9-(p-diethylaminostyrylanthrathene), 1,1-bis-(4-dibenzylaminophenyl) propane, styryl anthrathene, styryl pyrazoline, phenyl hydrazone, α-phenyl stilbene derivatives, thiazole derivatives, triazole derivatives, phenazine derivatives, acridine derivatives, benzofuran derivatives, benzimidazole derivatives, thiophene derivatives, etc.

The positive-hole transport materials can be used alone or in combination.

Specific examples of the charge transport polymers for use in the photoreceptor of the present invention are as follows.

(a) Polymers Having a Carbazole Ring

Specific examples of such materials include poly-N-vinyl carbazole, and the compounds disclosed in JOPs 50-82056, 54-9632, 54-11737, 04-175337, 04-183719, and 06-234841.

(b) Polymers Having a Hydrazone Skeleton

Specific examples of such materials include the compounds disclosed in JOPs. 57-78402, 61-20953, 61-296358, 01-134456, 01-179164, 03-180851, 03-180852, 03-50555, 05-310904 and 06-234840.

(c) Polysilylene Compounds

Specific examples of such polymers include the polysilylene compounds disclosed in JOPs 63-285552, 01-88461, 04-264130, 04-264131, 04-264132, 04-264133 and 04-289867.

(d) Polymers Having a Triaryl Amine Skeleton

Specific examples of such polymers include N,N-bis(4-methylphenyl)-4-aminopolystyrene, and the compounds disclosed in JOPs 01-134457, 02-282264, 02-304452, 04-133065, 04-133066, 05-40350 and 05-202135.

(e) Other Polymers

Specific examples of such polymers include condensation products of nitropyrene with formaldehyde, and the compounds disclosedin JOPs 51-73888, 56-150749, 06-234836and06-234837.

The charge transport polymer material (the polymer having an electron donating group) for use in the CTL is not limited thereto, and known polymers, copolymers (such as random, block and graft copolymers) and star polymers, which are obtained from one or more known monomers and which include an electron donating group, can also be used. In addition, crosslinking polymers having an electron donating group disclosed in, for example, JOP 03-109406, can also be used.

Among these charge transport materials, compounds having a triaryl amine structure are preferably used for the photoreceptor of the present invention. Specific examples of such compounds have been disclosed in JOPs 64-1728, 64-13061, 64-19049, 04-11627, 04-225014, 04-230767, 04-320420, 05-232727, 07-56374, 09-127713, 09-222740, 09-265197, 09-211877 and 09-304956.

Specific examples of the charge transport polymers having a triarylamine structure, which can be preferably used in the photoreceptor of the present invention, include the following polymer materials.

Polymers Having Formula (1)

(1)

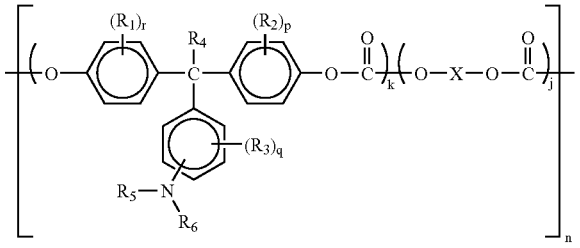

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

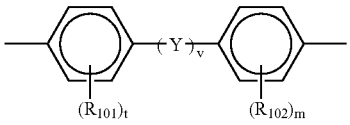

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O-Z-O—CO— (Z represents a divalent aliphatic group), or a group having the following formula:

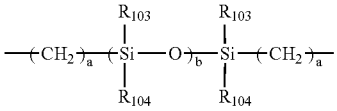

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein each of $R_{101}$, $R_{102}$, $R_{103}$ and $R_{104}$ may be the same or different from the others.

Specific Examples of the Polymers Having Formula (1)

In the above-mentioned formula, $R_1$, $R_2$ and $R_3$ independently represent a substituted or unsubstituted alkyl group or a halogen atom. Specific examples thereof are as follows.

Suitable alkyl groups include linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group, a cyano group, an alkoxy group having from 1 to 4 carbon atoms, a phenyl group, or a phenyl group which is substituted with an alkyl group having from 1 t 4 carbon atoms or an alkoxy group having from 1 to 4 carbon atoms.

Specific examples thereof include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

Specific examples of the halogen atom include fluorine, chlorine, bromine and iodine atoms.

$R_4$ represents a hydrogen atom, a substituted or unsubstituted alkyl group. Specific examples of the alkyl groups are the groups mentioned above for use in $R_1$ to $R_3$.

$R_5$ and $R_6$ independently represent a substituted or unsubstituted aryl group. Specific examples thereof include aromatic hydrocarbon groups and heterocyclic ring groups. Specific examples of the aromatic hydrocarbon groups include phenyl groups, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), and non-condensed polycyclic ring groups (e.g., biphenyl group, and terphenyl groups).

Specific examples of the heterocyclic ring groups include thienyl groups, benzothienyl groups, furyl groups, benzofuryl groups, and carbazolyl groups.

The above-mentioned aryl groups can have a substituent. Specific examples of the substituent include the following groups:

(1) halogen atoms, trifluoromethyl groups, cyano groups and nitro groups.

(2) alkyl groups for use in $R_1$, $R_2$ and $R_3$.

(3) alkoxy groups (—$OR_{105}$). Specific examples of the group R105 include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

(5) substituted mercapto groups and aryl mercapto groups. Specific examples thereof include methylthio groups, ethylthio groups, phenylthio groups, p-methylphenylthio groups, etc.

(6) amino groups substituted with an alkyl group. Specific examples of the alkyl groups are mentioned above in numbered paragraph (2) above. Specific examples of the substituted amino groups include dimethylamino groups, diethylamino groups, N-methyl-N-propylamino groups, N,N-dibenzylamino groups, etc.

(7) acyl groups. Specific examples of the acyl groups include acetyl groups, propionyl groups, butylyl groups, malonyl groups, benzoyl groups, etc.

The group X can be incorporated in the main chain of the polymers by polymerizing a diol compound having a triarylamino group having the below-mentioned formula (A) together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (A) together with bischloroformate which can be derived from the diol compound having formula (B). In this case, the resultant polymers are alternating copolymers.

Formula (A)

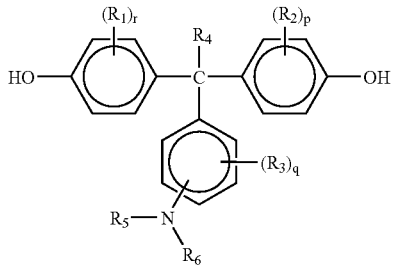

Formula (B)

HO—X—OH

Specific examples of the diol compounds having formula (B) include aliphatic diols such as 1,3-propane diol, 1,4-butane diol, 1,5-pentane diol, 1,6-hexane diol, 1,8-octane diol, 1,10-decane diol, 2-methyl-1,3-propane diol, 2,2-dimethyl-1,3-propane diol, 2-ethyl-1,3-propane diol, diethylene glycol, triethylene glycol, polyethylene glycol, and polytetramethyleneether glycol; alicyclic diols such as 1,3-cyclohexane diol, and cyclohexane-1,4-dimethanol; etc.

In addition, diols having an aromatic ring can also be used. Specific examples thereof include 4,4-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 4,4'-dihydroxyphenylsulfone, 4,4'-dihydroxyphenylsulfoxide, 4,4'-dihydroxyphenylsulfide, 3,3'-dimethyl-4,4'-dihydroxyphenylsulfide, 4,4'-dihydroxydiphenyloxide, 2,2-bis(4-hydroxyphenyl)hexafluoropropane, 9,9-bis(4-hydroxyphenyl)fluorenone, 9,9-bis(4-hydroxyphenyl) xanthene, ethyleneglycol-bis(4-hydroxybenzoate), diethyleneglycol-bis(4-hydroxybenzoate), triethyleneglycol-bis(4-hydroxybenzoate), 1,3-bis(4-hydroxyphenyl)tetramethyldisiloxane, phenol-modified silicone oils, etc.

Polymers Having Formula (2)

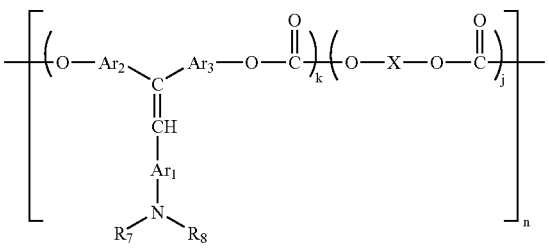

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

Specific Examples of the Polymers Having Formula (2)

The compounds having formula (2) will be explained.

Characters $R_7$ and $R_8$ independently represent a substituted or unsubstituted aryl group. Specific examples thereof are as follows.

Specific examples thereof include aromatic hydrocarbon groups and heterocyclic ring groups. Specific examples of the aromatic hydrocarbon groups include phenyl groups, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), non-condensed polycyclic ring groups (e.g., biphenyl groups, and terphenyl groups), and groups having the following formula:

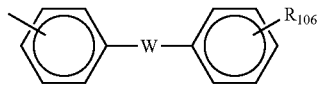

wherein W represents —O—, —S—, —SO—, —$SO_2$—, —CO— and a group having one of the following formulae:

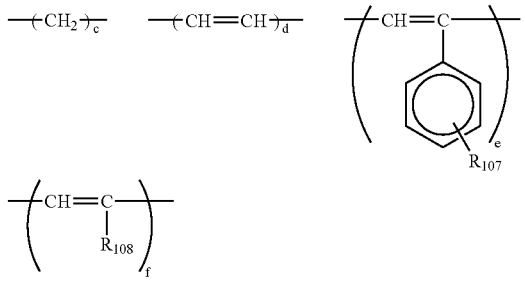

wherein c is an integer of from 1 to 12, d is an integer of from 1 to 3, e is an integer of from 1 to 3, and f is an integer of from 1 to 3.

Specific examples of the heterocyclic ring groups include thienyl groups, benzothienyl groups, furyl groups, benzofuryl groups, and carbazolyl groups.

Specific examples of the arylene groups for use as $Ar_1$, $Ar_2$ and $Ar_3$ include divalent groups of the aryl groups mentioned above for use in $R_7$ and $R_8$.

The above-mentioned aryl groups can have a substituent. The substituents described below are also specific examples of $R_{106}$, $R_{107}$ and $R_{108}$.

(1) halogen atoms, trifluoromethyl groups, cyano groups and nitro groups.

(2) alkyl groups such as linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group or a cyano group, an alkoxy group having from 1 to 4 carbon atoms, a phenyl group, or a phenyl group which is optionally substituted with an alkyl group having from 1 t 4 carbon atoms or an alkoxy group having from 1 to 4 carbon atoms.

Specific examples of the alkyl groups include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

(3) alkoxy groups (—$OR_{109}$). Specific examples of the group $R_{109}$ include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

(5) substituted mercapto groups and aryl mercapto groups. Specific examples thereof include methylthio groups, ethylthio groups, phenylthio groups, p-methylphenylthio groups, etc.

(6) amino groups substituted with an alkyl group, which have a formula, —$N(R_{110})(R_{111})$.

Specific examples of the groups $R_{110}$ and $R_{111}$ are alkyl groups described in numbered paragraph (2) above and aryl groups. Specific examples of the aryl groups include phenyl groups, biphenyl groups, and naphthyl groups. These groups can have a substituent such as alkoxy groups having from 1 to 4 carbon atoms, alkyl groups having from 1 to 4 carbon atoms, and halogen atoms. In addition, the nitrogen atom can share bond connectivity with a carbon atom in the aryl groups to form a ring.

Specific examples of the substituted amino groups include diethylamino groups, N-methyl-N-phenylamino groups, N,N-diphenylamino groups, N,N-di(p-tolyl)amino groups, dibenzylamino groups, piperidino groups, morphorino groups, julolidyl groups, etc.

(7) alkylenedioxy groups and alkylenedithio groups such as methylenedioxy groups and methylenedithio groups.

The group X can be incorporated in the main chain of the polymers by polymerizing a diol compound having a triarylamino group having the below-mentioned formula (C) together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (C) together with a bischloroformate which can be derived from the diol compound having formula (B). In this case, the resultant polymers are alternating copolymers.

Formula (C)

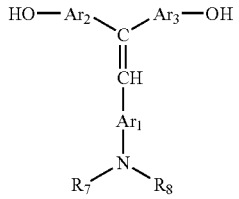

Formula (B)

Specific examples of the diol compounds (B) are mentioned above in formula (1).

Polymers Having Formula (3)

(3)

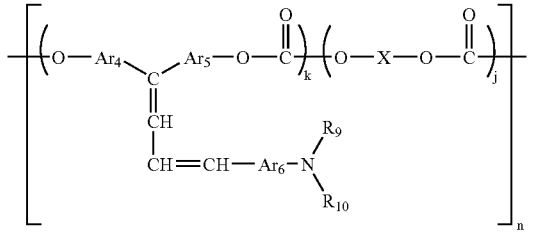

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (1).

Specific Examples of the Polymers Having Formula (3)

$R_9$ and $R_{10}$ independently represent a substituted or unsubstituted aryl group. Specific examples thereof include the following.

Specific examples of the aromatic hydrocarbon groups for use as the groups $R_9$ and $R_{10}$ include a phenyl group, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), and non-condensed polycyclic ring groups (e.g., biphenyl groups, and terphenyl groups).

Specific examples of the heterocyclic ring groups for use as the groups $R_9$ and $R_{10}$ include thienyl groups, benzothienyl groups, furyl groups, benzofuryl groups, and carbazolyl groups.

As the arylene groups for use in $Ar_4$, $Ar_5$ and $Ar_6$, divalent groups of the aryl groups mentioned above for use in $R_9$ and $R_{10}$ can be used. The above-mentioned aryl groups and arylene groups can have a substituent. Specific examples of the substituent include the following groups:

(1) halogen atoms, trifluoromethyl groups, cyano groups and nitro groups.

(2) alkyl groups such as linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group or a cyano group, an alkoxy group having from 1 to 4 carbon atoms, a phenyl group, or a phenyl group which is optionally substituted with an alkyl group having from 1 to 4 carbon atoms or an alkoxy group having from 1 to 4 carbon atoms.

Specific examples of the alkyl groups include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

(3) alkoxy groups (—$OR_{112}$). Specific examples of the group $R_{112}$ include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

(5) substituted mercapto groups and aryl mercapto groups. Specific examples thereof include methylthio groups, ethylthio groups, phenylthio groups, p-methylphenylthio groups, etc.

(6) amino groups substituted with an alkyl group. Specific examples of the alkyl groups are mentioned above in numbered paragraph (2) above. Specific examples of the substituted amino groups include dimethylamino groups, diethylamino groups, N-methyl-N-propylamino groups, N,N-dibenzylamino groups, etc.

(7) acyl groups. Specific examples of the acyl groups include acetyl groups, propionyl groups, butylyl groups, malonyl groups, benzoyl groups, etc.

The group X can be incorporated in the main chain of the polymers by polymerizing a diol compound having a triarylamino group having the below-mentioned formula (D) together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (D) together with bischloroformate which can be derived from the diol compound having formula (B). In this case, the resultant polymers are alternating copolymers.

Formula (D)

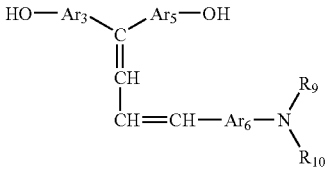

Formula (B)

Specific examples of the diol compounds having formula (B) include the compounds mentioned above for use in the compounds having formula (1).

Polymers Having Formula (4)

(4)

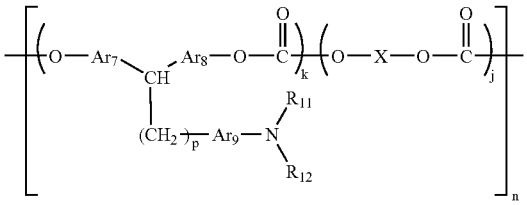

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

Specific Examples of the Polymers Having Formula (4)

$R_{11}$ and $R_{12}$ independently represent a substituted or unsubstituted aryl group. Specific examples thereof include the following.

Specific examples of the aromatic hydrocarbon groups for use as the groups $R_{11}$ and $R_{12}$ include phenyl groups, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), and non-condensed polycyclic ring groups (e.g., biphenyl groups, and terphenyl groups).

Specific examples of the heterocyclic ring groups include thienyl groups, benzothienyl groups, furyl groups, benzofuryl groups, and carbazolyl groups.

As the arylene groups for use in $Ar_7$, $Ar_8$ and $Ar_9$, divalent groups of the aryl groups mentioned above for use in $R_{11}$ and $R_{12}$ can be used. The above-mentioned aryl groups and arylene groups can have a substituent. Specific examples of the substituent include the following groups:

(1) halogen atoms, trifluoromethyl groups, cyano groups and nitro groups.

(2) alkyl groups such as linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group or a cyano group, an alkoxy group having from 1 to 4 carbon atoms, a phenyl group, or a phenyl group which is optionally substituted with an alkyl group having from 1 t 4 carbon atoms or an alkoxy group having from 1 to 4 carbon atoms.

Specific examples of the alkyl groups include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

(3) alkoxy groups (—OR112). Specific examples of the group R112 include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

(5) substituted mercapto groups and aryl mercapto groups. Specific examples thereof include methylthio groups, ethylthio groups, phenylthio groups, p-methylphenylthio groups, etc.

(6) amino groups substituted with an alkyl group. Specific examples of the alkyl groups are mentioned above in numbered paragraph (2) above. Specific examples of the substituted amino groups include dimethylamino groups, diethylamino groups, N-methyl-N-propylamino groups, N,N-dibenzylamino groups, etc.

(7) acyl groups. Specific examples of the acyl groups include acetyl groups, propionyl groups, butylyl groups, malonyl groups, benzoyl groups, etc.

The group X can be incorporated in the main chain of the polymers by polymerizing a diol compound having a triarylamino group having the below-mentioned formula (E)

together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (E) together with bischloroformate which can be derived from the diol compound having formula (B). In this case, the resultant polymers are alternating copolymers.

Formula (E)

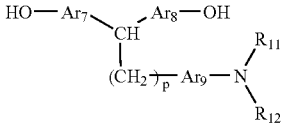

Formula (B)

Specific examples of the diol compounds having formula (B) include the compounds mentioned above for use in the compounds having formula (1).

Polymers Having Formula (5)

(5)

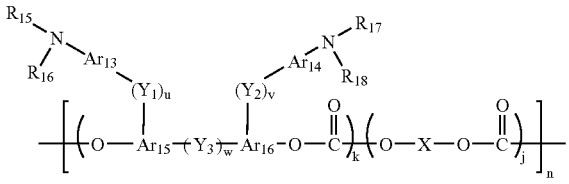

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (1).

Specific Examples of the Polymers Having Formula (5)

$R_{15}$ to $R_{18}$ independently represent a substituted or unsubstituted aryl group. Specific examples thereof include the following.

Specific examples of the aromatic hydrocarbon groups include phenyl groups, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), and non-condensed polycyclic ring groups (e.g., biphenyl groups, and terphenyl groups).

Specific examples of the heterocyclic ring groups include thienyl groups, benzothienyl groups, furyl groups, benzofuryl groups, and carbazolyl groups.

As the arylene groups for use in the groups $Ar_{13}$ to $Ar_{16}$, divalent groups of the aryl groups mentioned above for use in the groups $R_{15}$ to $R_{18}$ can be used. The above-mentioned aryl groups and arylene groups can have a substituent. Specific examples of the substituent include the following groups:

(1) halogen atoms, trifluoromethyl groups, cyano groups and nitro groups.

(2) alkyl groups such as linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group or a cyano group, an alkoxy group having from 1 to 4 carbon atoms, a phenyl group, or a phenyl group which is optionally substituted with an alkyl group having from 1 t 4 carbon atoms or an alkoxy group having from 1 to 4 carbon atoms.

Specific examples of the alkyl groups include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

(3) alkoxy groups (—$OR_{112}$). Specific examples of the group $R_{112}$ include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

$Y_1$, $Y_2$ and $Y_3$ independently represent a direct bonding, a substituted or unsubstituted alkylene group, a substituted or unsubstituted cycloalkylene group, a substituted or unsubstituted alkylene ether group, an oxygen atom, a sulfur atom, or a vinylene group.

As the alkylene group, divalent groups derived from the alkyl groups mentioned above in numbered paragraph (2) above can be used. Specific examples of the alkylene groups include methylene groups, ethylene groups, 1,3-propylene groups, 1,4-butylene groups, 2-methyl-1,3-propylene groups, difluoromethylene groups, hydroxyethylene groups, cyanoethylene groups, methoxyethylene groups, phenylmethylene groups, 4-methylphenylmethylene groups, 2,2-propylene groups, 2,2-butylene groups, diphenylmethylene groups, etc.

Specific examples of the cycloalkylene groups include 1,1-cyclopentylene groups, 1,1-cyclooctylene groups, etc.

Specific examples of the alkylene ether groups include dimethylene ether groups, diethylene ether groups, ethylene methylene ether groups, bis(triethylene) ether groups, polytetramethylene ether groups, etc.

The group X can be incorporated in the main chain of the polymers by polymerizing a diol compound having a triarylamino group having the below-mentioned formula (G) together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (G) together with bischloroformate which can be derived from the diol compound having formula (B). In this case, the resultant polymers are alternating copolymers.

Formula (G)

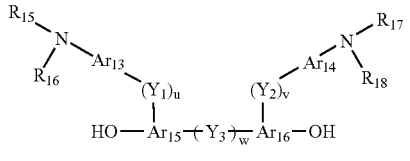

Formula (B)

Specific examples of the diol compounds having formula (B) include the compounds mentioned above for use in formula (1).

Polymers Having Formula (6)

(6)

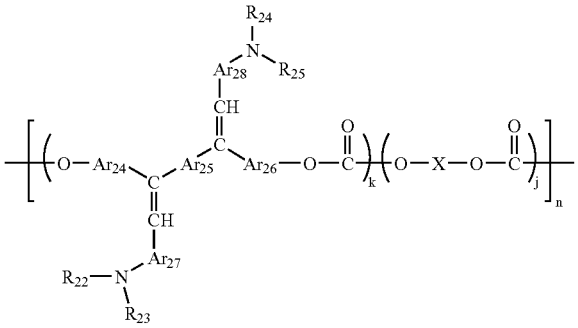

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (1).

Specific Examples of the Polymers Having Formula (6)

$R_{22}$ to $R_{25}$ independently represent a substituted or unsubstituted aryl group. Specific examples thereof include the following.

Specific examples of the aromatic hydrocarbon groups include phenyl groups, condensed ring groups (e.g., naphthyl groups, pyrenyl groups, 2-fluorenyl groups, 9,9-dimethyl-2-fluorenyl groups, azulenyl groups, anthryl groups, triphenyl groups, chrysenyl groups, fluorenylidenephenyl groups, and 5H-dibenzo[a,d]cycloheptenylidenephenyl groups), and non-condensed polycyclic ring groups (e.g., biphenyl groups, and terphenyl groups).

Specific examples of the heterocyclic ring groups include thienyl groups, benzothienyl groups, furyl groups, benzofuryl groups, and carbazolyl groups.

As the arylene groups for use in the groups $Ar_{24}$ to $Ar_{27}$, divalent groups of the aryl groups mentioned above for use in the groups $R_{22}$ to $R_{25}$ can be used. The above-mentioned aryl groups and arylene groups can have a substituent. Specific examples of the substituent include the following groups:

(1) halogen atoms, trifluoromethyl groups, cyano groups and nitro groups.

(2) alkyl groups such as linear or branched alkyl groups having from 1 to 12 carbon atoms, preferably from 1 to 8 carbon atoms and more preferably from 1 to 4 carbon atoms. These alkyl groups can be substituted with a halogen atom, a hydroxyl group or a cyano group, an alkoxy group having from 1 to 4 carbon atoms, a phenyl group, or a phenyl group which is optionally substituted with an alkyl group having from 1 t 4 carbon atoms or an alkoxy group having from 1 to 4 carbon atoms.

Specific examples of the alkyl groups include methyl groups, ethyl groups, n-propyl groups, i-propyl groups, t-butyl groups, s-butyl groups, n-butyl groups, i-butyl groups, trifluoromethyl groups, 2-hydroxyethyl groups, 2-cyanoethyl groups, 2-ethoxyethyl groups, 2-methoxyethyl groups, benzyl groups, 4-chlorobenzyl groups, 4-methylbenzyl groups, 4-methoxybenzyl groups, 4-phenylbenzyl groups, etc.

(3) alkoxy groups (—$OR_{118}$). Specific examples of the group $R_{118}$ include the alkyl groups defined in numbered paragraph (2) above. Specific examples of the alkoxy groups include methoxy groups, ethoxy groups, n-propoxy groups, i-propoxy groups, t-butoxy groups, n-butoxy groups, i-butoxy groups, 2-hydroxyethoxy groups, 2-cyanoethoxy groups, benzyloxy groups, 4-methylbenzyloxy groups, trifluoromethoxy groups, etc.

(4) aryloxy groups. Specific examples of the aryl group of the aryloxy groups include phenyl groups, and naphthyl groups, which can have a substituent such as alkoxy groups having from 1 to 4 carbon atoms, alkyl groups having from 1 to 4 carbon atoms, and halogen atoms. Specific examples of the aryloxy groups include phenoxy groups, 1-naphthyloxy groups, 2-naphthyloxy groups, 4-methylphenoxy groups, 4-methoxyphenoxy groups, 4-chlorophenoxy groups, 6-methyl-2-naphthyloxy groups, etc.

(5) substituted mercapto groups and aryl mercapto groups. Specific examples thereof include methylthio groups, ethylthio groups, phenylthio groups, p-methylphenylthio groups, etc.

(6) amino groups substituted with an alkyl group. Specific examples of the alkyl groups are mentioned above in numbered paragraph (2). Specific examples of the substituted amino groups include dimethylamino groups, diethylamino groups, N-methyl-N-propylamino groups, N,N-dibenzylamino groups, etc.

(7) acyl groups. Specific examples of the acyl groups include acetyl groups, propionyl groups, butylyl groups, malonyl groups, benzoyl groups, etc.

The group X can be incorporated in the main chain of the polymers by polymerizing a diol compound having a triarylamino group having the below-mentioned formula (L) together with a diol compound having the below-mentioned formula (B) using a method such as phosgene methods and ester exchange methods. In this case, the resultant polycarbonate resins are random or block copolymers. Alternatively, the group X can also be incorporated in the main chain by polymerizing the diol compound having formula (L) together with bischloroformate which can be derived from the diol compound having formula (B). In this case, the resultant polymers are alternating copolymers.

Formula (L)

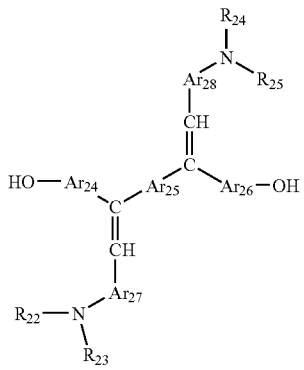

Formula (B)

Specific examples of the diol compounds having formula (B) include the compounds mentioned above for use in formula (1).

Specific examples of the polycarbonate including a triaryl amine structure in its side chains include compounds disclosed in JOPs 06-234838, 06-234839, 06-295077, 07-325409, 09-297419, 09-80783, 09-80784, 09-80772, 09-265201, etc.

In the charge transport polymer materials, repeat units having an electrically inactive structure are obtained from monomers which do not have a photoconductive property that compounds having triaryl amine structure have. Specific examples of such repeat units include the repeat units mentioned above in formula (B).

The above-mentioned charge transport polymer materials can be used alone or in combination.

Suitable methods for forming the CGL include thin film forming methods in a vacuum, and casting methods.

Specific examples of such thin film forming methods in a vacuum include vacuum evaporation methods, glow discharge decomposition methods, ionplating methods, sputtering methods, reaction sputtering methods, CVD (chemical vapor deposition) methods, and the like methods. A layer of the above-mentioned inorganic and organic materials can be formed by one of these methods.

The casting methods for forming the CGL typically include the following steps:

(1) preparing a coating liquid by mixing one or more inorganic or organic CGMs mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and more preferably from about 0.05 to about 2 μm.

Then the CTL 106 will be explained.

The CTL is typically prepared by preparing a CTL coating liquid in which a mixture of a CTM and a binder resin or a charge transport polymer material is dissolved or dispersed in a solvent, and then coating the coating liquid followed by drying.

Specific examples of the polymers for use as the binder resin of the CTL include thermoplastic resins and thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins, but are not limited thereto.

These polymer materials can be used alone or in combination. In addition, copolymers of the monomers of the polymer materials mentioned above can also be used. Further, copolymers of the monomers with a CTM can also be used.

When a protective layer is prepared by coating, the CTL preferably includes a resin soluble in the solvent of the protective layer coating liquid to be coated thereon, such as polystyrene, polyarylate, polycarbonate and phenolic resins, to make the interface of the protective layer and the CTL unclear.

When an electrically inactive polymer is used in order to impart good stability to withstand environmental conditions to the resultant photoreceptor, resins such as polyester, polycarbonate, acrylic resins, polystyrene, polyvinylidene chloride, polyethylene, polypropylene, fluorine-containing resins, polyacrylonitrile, acrylonitrile/styrene/butadiene copolymers, acrylonitrile/styrene copolymers and ethylene/vinyl acetate copolymers are preferably used.

Electrically inactive charge transport polymer materials mean polymers which do not have a structure having a photoconductive property, such as the triarylamine structure.

Repeat units having an electrically inactive structure can be obtained from monomers which do not have a photoconductive property that compounds having a triaryl amine structure have. Specific examples of repeat units include the repeat units mentioned above in formula (B).

When these resins are used as an additive together with a binder resin, the content thereof is preferably not greater than 50% by weight in view of photosensitivity of the resultant photoreceptor.

Specific examples of the CTMs for use in the CTL include low molecular weight electron transport materials, low molecular weight positive hole transport materials, and charge transport polymer materials.

When a low molecular weight CTM is used, the content thereof is preferably from 40 to 200 parts by weight, and preferably from 70 to 150 parts by weight, per 100 parts by weight of the resin components included therein. When a charge transport polymer is used, the content thereof is preferably from 0 to 500 parts by weight, and preferably from 0 to 150 parts by weight, per 100 parts by weight of the charge transport components included therein.

When two or more kinds of CTMs are included in the CTL, the difference in ionization potential between the two or more kinds of CTMs is as small as possible, specifically the difference is preferably not greater than 0.15 eV. In this case, it is prevented that one of the CTMs serves as a trap of the other CTMs.

Forming a protective layer is disadvantageous to the photosensitivity of the photoreceptor. In order to avoid deterioration of photosensitivity, it is preferable to enhance the charge mobility in the CTL, particularly at a low electric field. Specifically, the charge mobility of the protective layer is preferably not less than $1.2\times10^{-5}$ $cm^2/V\cdot sec$ at an electric field of $4\times10^5$ V/cm. In addition, the dependence (β) of the charge mobility on the electric field, which is defined below, is preferably not greater than $1.6\times10^{-3}$.

Figure 11:
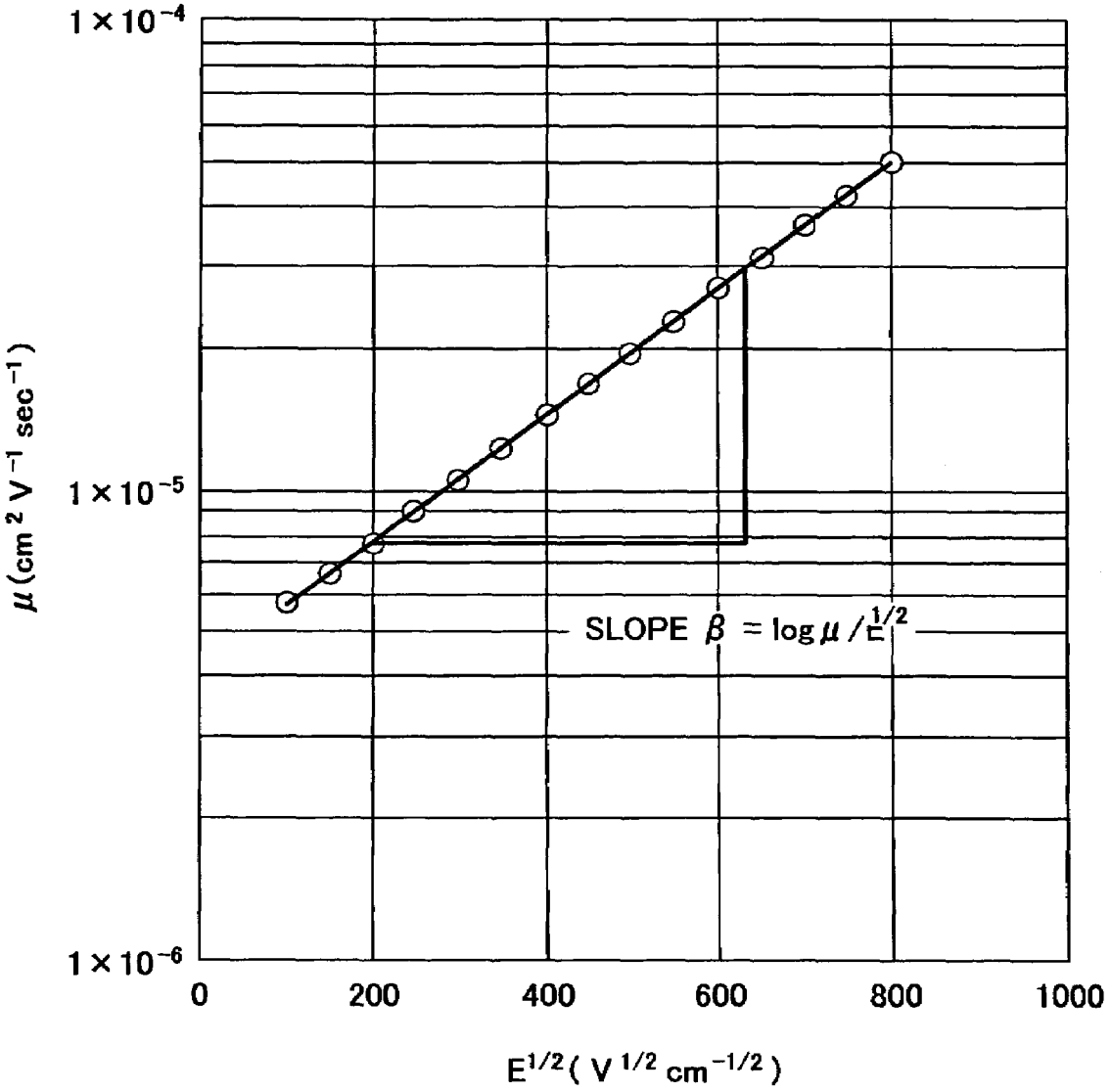
FIG. 11 is a graph for explaining the dependence (β) of the charge mobility of a CTL on electric field strength.

The dependence (β) can be determined as follows. The charge mobility of a CTL is measured while the electric field is changed. As illustrated in FIG. 11, the data are plotted in a semilogarithmic paper while the charge mobility is plotted on the vertical axis in units of $cm^2/V\cdot sec$ and the square root of the electric field is plotted on the horizontal axis in units of $V^{1/2}/cm^{1/2}$, to obtain an approximation line. The slope of the approximation line is defined as the dependence (β). When the slope is sharp, the charge mobility of the protective layer has a strong dependence on the electric field. Specifically, the dependence (β) is expressed by the following equation:

$$\beta=\log \mu/E^{1/2} \quad [1].$$

It is said that when a CTL has a large β, the charge mobility of the CTL largely changes depending on the electric field.

A CTL with large β typically has a low charge mobility at a low electric field. Therefore, when such a CTL is used for a photoreceptor, the photoreceptor has the following disadvantages:

(1) residual potential is high; and (2) when the photoreceptor is used while the potential of the charged photoreceptor is decreased, there is a case where the photoreceptor has poor response.

In order to impart high photosensitivity to a photoreceptor, the content of the CTMs in the CTL is preferably not less than 70 parts by weight per 100 parts by weight of the resin components in the CTL.

Suitable solvents for use in the CTL coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. These solvents can be used alone or in combination.

The CTL can include one or more additives such as antioxidants, plasticizers, lubricants and ultraviolet absorbents, if desired. Specific examples thereof are mentioned below. These additives are added in the CTL in an amount of from 0.1 to 50 parts by weight, preferably from 0.1 to 20 parts by weight, per 100 parts by weight of the resin components therein. The leveling agents are added in an amount of from 0.001 to 5 parts by weight per 100 parts by weight of the resin components therein.

Suitable coating methods for use in coating the CTL coating liquid include dip coating methods, spray coating methods, ring coating methods, roll coating methods, gravure coating methods, nozzle coating methods, screen coating methods, etc.

The thickness of the CTL is generally from 15 to 40 μm, and preferably from 15 to 30 μm. When it is desired to form images having good resolution, the thickness of the CTL is preferably not greater than 25 μm.

Then the mixture type photosensitive layer will be explained.

The mixture type photosensitive layer can be prepared by coating a coating liquid in which constituents of the photosensitive layer are dissolved or dispersed in a proper solvent, and then drying the coated liquid. Suitable coating methods include the coating methods mentioned above for use in the CTL. In addition, suitable binder resins, CGMs, and CTMs for use in the mixture type photosensitive layer include those mentioned above for use in the CGL and CTL.

The mixture type photosensitive layer can include additives such as antioxidants, plasticizers, lubricants, ultraviolet absorbents and leveling agents.

These additives (except for the leveling agents) are added in the CTL in an amount of from 0.1 to 100 parts by weight, preferably from 0.1 to 30 parts by weight, per 100 parts by weight of the resin components therein. The leveling agents are added in an amount of from 0.001 to 5 parts by weight per 100 parts by weight of the resin components therein.

The thickness of the mixture type photosensitive layer is generally from 5 to 50 μm, and preferably from 10 to 35 μm. When it is desired to form images having good resolution, the thickness of the mixture type photosensitive layer is preferably from 10 to 28 μm.

Then the protective layer 103 will be explained.

The protective layer is formed overlying the photosensitive layer 102 and serves as an outermost layer. The protective layer is formed to improve the abrasion resistance of the photoreceptor.

The protective layer includes a resin as a main component, and can include a filler or an abrasion preventing agent. Suitable resins for use in the protective layer include binder resins mentioned above for use in the CGL and charge transport polymers mentioned above.

When a thermoplastic resin is used for the protective layer, it is preferable that the protective layer is formed in such a manner that there is no interface between the protective layer and the underlying photosensitive layer (or CTL). Such a structure can be formed by using a resin, which can be mixed with the resin in the underlying layer, for the protective layer.

When the protective layer is formed, the following relationship is preferably satisfied:

$$1.3<W1/W2<1.9,$$

wherein W1 represents the weight of the protective layer, which is measured after coating the protective layer coating liquid and allowing the coated liquid to settle for 1 hour under conditions of 25±3° C. and 53±5% RH; and W2 represents the weight of the protective layer, which is measured after coating the protective layer coating liquid and drying the coated liquid upon application of heat thereto (specifically, by heating at a temperature not lower than the boiling point of the solvent included in the coating liquid for 10 minutes or more).

In this case, the CTM included in the photosensitive layer properly diffuses into the protective layer and thereby the charges induced in the photosensitive layer by imagewise light can be fully injected into the protective layer.

When a crosslinking resin is used for the protective layer, it is preferable that a charge transporting group is incorporated in the crosslinking resin or a charge transport polymer is included in the protective layer. It is also possible that a low molecular weight CTM is included in the protective layer in combination with a crosslinking resin. However, in this case a bleeding problem often occurs such that the low molecular weight CTM is bled from the protective layer.

Specific examples of the filler for use in the protective layer include titanium oxide, silica, silicone rubbers, alumina, zirconium oxide, antimony oxide, magnesium oxide, silicon nitride, boron nitride, calcium oxide, calcium carbonate, barium sulfate, etc. In particular, silica and α-alumina are preferable because of having good charge properties and good durability improving effect.

These fillers can be subjected to a surface treatment to improve the dispersibility of the fillers in the coating liquid.

In order to improve the abrasion resistance of the photoreceptor, particulate polyolefins (disclosed in JOP 11-212284), fluorine-containing oils (disclosed in JOP 11-258843), silicone resin powders (disclosed in JOP 11-265082), silicone oils (disclosed in JOP 11-271999), spherical particles of vinyl type thermoplastic polymers or condensed thermoplastic polymers (disclosed in JOP 11-295911), and fluorine resin powders (disclosed in JOP 11-305470) can also be used for the protective layer.

The protective layer coating liquid is typically prepared by mixing a filler or an abrasion preventing agent with a binder resin in a proper solvent. If necessary, the filler or abrasion preventing agent is subjected to a dispersion treatment (or a dissociating treatment).

In order to reduce the potential (i.e., residual potential) of lighted portions of the photoreceptor, a resistivity decreasing agent can be contained in the protective layer. Specific examples of the resistivity decreasing agent include polyhydric alcohols partially esterified with fatty acids (e.g., mono esters of sorbitan with fatty acids, esters of pentaerythritol with fatty acids, etc.), adducts of aliphatic alcohols with ethylene oxide, adducts of fatty acids with ethylene oxide, adducts of alkyl phenols with ethylene oxide, adducts of ethylene oxides with polyhydric alcohols partially esterified with fatty acids, carboxylic acid derivatives, etc.

Suitable solvents for use in preparing the protective layer coating liquid include the ketone solvents, ether solvents, aromatic solvents, halogen-containing solvents, and ester solvents, mentioned above for use in the CTL coating liquids.

The dispersing treatment and the dissociating treatment can be performed using ball mills, vibration mills, sand mills, KD mills, three-roll mills, pressure homogenizers, liquid-colliding-type dispersion machines, pressure jet mills, and supersonic dispersion machines.

The content of the filler or the abrasion preventing agent) in the protective layer is preferably from 5 to 70% by weight, and more preferably from 10 to 70%. When the content is too low, the protective layer has insufficient abrasion resistance. In contrast, when the content is too high, the protective layer tends to have a rough surface.

Suitable coating method for use in forming the protective layer include the coating methods mentioned above for use in forming the CTL. In particular, spray coating methods and ring coating methods are preferable because a protective layer having the desired properties can be stably produced.

The thickness of the protective layer is from 0.5 to 15 μm, and preferably from 2 to 10 μm. When the protective layer is too thin, the resultant photoreceptor has insufficient abrasion resistance. In contrast, when the thickness is not less than 2 μm, the photoreceptor has a life as long as that of other parts and devices of the image forming system.

In general, the residual potential of a photoreceptor increases in proportion to square of the thickness of the protective layer thereof. Therefore, the thickness of the protective layer is preferably determined so that the flexture time of the photoreceptor is shorter than the exposure-development interval in the image forming apparatus for which the photoreceptor is used. In this case, it is possible to prevent delayed carriers from staying in the photosensitive layer and protective layer, and thereby formation of previously formed images can be avoided.

However, since the photoreceptor of the present invention has a property such that the potential ($P_L$) of a lighted portion of the photoreceptor changes at a rate not greater than 700 V/sec during a time period of from a time 35 msec after the exposure to the transition time of the photoreceptor, the limitation such that the transition time of the photoreceptor is shorter than the exposure-development interval of the image forming apparatus is not necessary therefor. Therefore, the protective layer can be thickened, and thereby the photoreceptor has long life. However, the protective layer is too thick, the manufacturing cost of the photoreceptor increases. Therefore, the thickness is preferably not greater than 10 μm.

If desired, the protective layer can include additives such as antioxidants, plasticizers, ultraviolet absorbents, and leveling agents. The additives are mentioned below, and can be used alone or in combination.

In the photoreceptor of the present invention, an undercoat layer 104 can be formed between the substrate 101 and the photosensitive layer 102 (or the CGL 105) to improve adhesion between the substrate and the photosensitive layer; to prevent formation of moiré; to improve the coating property of the overlying layer; to reduce the residual potential; and to prevent injection of charges from the substrate into the photosensitive layer.

The undercoat layer typically includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide.

The undercoat layer can also be formed by coating a coating liquid using a proper solvent and a proper coating method mentioned above for use in the photosensitive layer.

In addition, metal oxide layers formed by a sol-gel method using a silane coupling agent, titanium coupling agent or a chromium coupling agent can also be used as the undercoat layer.

Further, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0.1 to 5 μm.

In the photoreceptor of the present invention, one or more additives such as antioxidants, plasticizers, lubricants, ultraviolet absorbents, low molecular weight charge transport materials and leveling agents can be used in one or more layers of the photosensitive layer, CGL, CTL, undercoat layer, and protective layer to improve the gas barrier property of the outermost layer of the photoreceptor and the stability thereof to withstand environmental conditions.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Specific examples of the low molecular weight CTMs include the CTMs mentioned above for use in the CTL 105.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Each of the following undercoat layer coating liquid, a CGL coating liquid and a CTL coating liquid was coated on an aluminum cylinder with a diameter of 30 mm and then dried to overlay an undercoat layer having a thickness of 4.0 μm, a CGL having a thickness of 0.3 μm, and CTL having a thickness of 20 μm.

| Undercoat layer coating liquid | |
|---|---|
| Alkyd resin (BEKKOZOL 1307-60-EL from Dainippon Ink & Chemicals, Inc.) | 10 parts |
| Melamine resin (SUPER BEKKAMIN G-821-60 from Dainippon Ink & Chemicals, Inc.) | 7 parts |
| Titanium dioxide (CR-EL from Ishihara Sangyo Kaisha Ltd.) | 40 parts |
| Methyl ethyl ketone | 200 parts |

| CGL coating liquid | |
|---|---|
| Bisazo pigment having the following formula (M) | 2.5 parts |

(M)

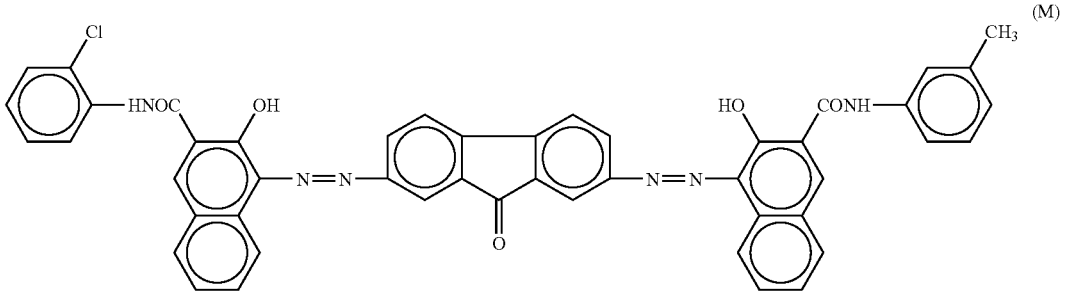

| | |
|---|---|
| Polyvinyl butyral (XYHL from Union Carbide Corp.) | 0.25 parts |
| Cyclohexanone | 200 parts |
| Methyl ethyl ketone | 80 parts |

| CTL coating liquid | |
|---|---|
| Charge transport polymer having the following formula (N) (weight average molecular weight of 110,000) | 13.5 parts |

-continued

| CTL coating liquid | |
|---|---|
| 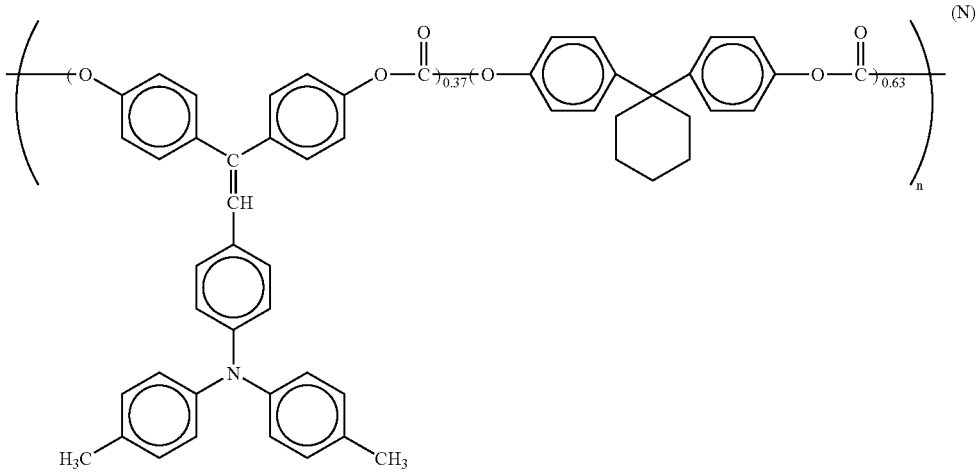 (n represents the repeat number) | |
| CTM having the following formula (P) | 1.5 parts |
| 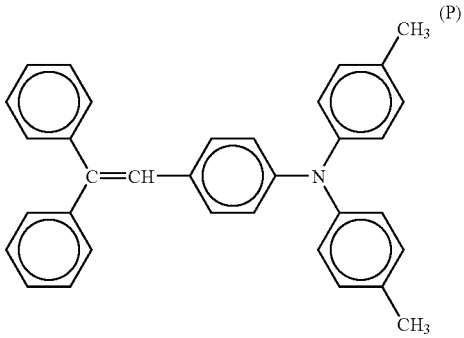 | |
| Tetrahydrofuran | 85 parts |
| 1% tetrahydrofuran solution of silicone oil (silicone oil: KF50–100CS from Shin-Etsu Chemical Industry Co., Ltd.) | 1 part |

Then the following components were mixed and dispersed for 24 hours in a ball mill containing alumina balls to prepare a protective layer coating liquid. The protective layer coating liquid was coated by spray coating on the CTL and then dried to form a protective layer having a thickness of 1.5 μm.

| Protective layer coating liquid | |
|---|---|
| Z-form polycarbonate resin (viscosity average molecular weight of 50,000, from Teijin Chemicals Ltd.) | 7 parts |
| α-alumina (SUMICORUNDUM AA-07 from Sumitomo Chemical Co., Ltd.) | 3 parts |
| Resistivity decreasing agent (BYK-P105 from BYK Chemie) | 0.2 parts |
| Cyclohexanone | 120 parts |
| Tetrahydrofuran | 240 parts |

Thus, a photoreceptor of Example 1 was prepared.

Comparative Example 1

The procedure for preparation of the photoreceptor in Example 1 was repeated except that the protective layer was not formed.

Thus, a photoreceptor of Comparative Example 1 was prepared.

Comparative Example 2

The procedure for preparation of the photoreceptor in Example 1 was repeated except that the thickness of the protective layer was changed to 12 μm.

Thus, a photoreceptor of Comparative Example 2 was prepared.

The thus prepared photoreceptors were evaluated with respect to the following items.

1. Transition Time

The evaluation apparatus described in JOP 2000-275872 incorporated herein by reference was used to determine change of the potential ($P_L$) of a lighted portion with time (i.e., the relationship between the potential ($P_L$) of a lighted portion and the exposure-development interval (Ted)) and the transition time.

The measuring conditions were as follows.

Linear speed of photoreceptor: 160 mm/s

Resolution in the sub-scanning direction: 400 dpi

Power of light on the image forming surface: 0.30 mW (exposure: 0.40 μJ/cm$^2$)

Discharger: operated

Potential of photoreceptor: −800 V

The position of the probe of the potential meter was changed to change the time from light irradiation to measurement of the potential ($P_L$).

2. Thickness of Photosensitive Layer

The total thickness of the undercoat layer, CGL, CTL and protective layer was measured at intervals of 1 cm in the longitudinal direction of the photoreceptor by a thickness meter, FISCHERSCOPE MMS, manufactured by Fischer Instruments, which measures thickness utilizing eddy current to determine the average total thickness of the layers.

3. Charge Mobility

The CTL coating liquid was coated on a polyethylene terephthalate film having an aluminum layer thereon, followed by drying, to form a CTL having a thickness of 10 μm. A gold electrode with a thickness of 200 Å was formed on the CTL by vapor deposition to prepare a sample cell. The charge mobility was measured by a Time Of Flight method, which is as follows:

(1) A negative voltage is applied to the gold electrode on the CTL sandwiched by the gold electrode and the aluminum electrode which is grounded through a resistor;

(2) Nitrogen gas laser light irradiates the CTL from the gold electrode side to record change of the voltage generated at the resistor due to the photo-current flowing the resistor using a digital oscilloscope; and (3) Two tangent lines are drawn from a start and an end of the thus obtained voltage curve to determine the transit time (t) which is the intersection of the two tangent lines (in this case the voltage curve is plotted on a logarithmic paper).

The charge mobility (μ) was determined by the following equation:

$$\mu = L^2/(V \cdot t)$$

wherein L represents the thickness of the CTL, V represents the voltage applied to the CTL, and t represents the transit time.

The measurements were performed under a condition of 25° C. 50% RH.

4. Abrasion and Residual Image

Each of the photoreceptors was set in an electrophotographic image forming apparatus (IPSIO COLOR 8100 manufactured by Ricoh Co., Ltd.) which had been modified so that the exposure-development interval is 80 msec, to perform a running test in which 30,000 copies of an image which includes a rectangular solid image and characters and which has an image area proportion of 5% are produced.

The toner and developer used are the exclusive toner and developer of IPSIO COLOR 8100. In addition, the charger used is a short-range charging roller. The charging conditions were as follows:

Voltage of AC component: 2 kV (peak to peak voltage)

Frequency of AC component: 1.3 kHz

Voltage of DC component: DC voltage was controlled so that the charged photoreceptor has a potential of −700 V.

In addition, other conditions were as follows.

Development bias: −500 V

Environmental conditions: 24° C. 54% RH

The abrasion of the surface of the photoreceptor was determined as the difference in thickness of the layers before and after the running test.

In addition, the produced images were visually observed to determine whether the images have a residual image. The images were graded as follows.

Rank 5: No residual image is observed.

Rank 4: A very minor degree of residual image is observed.

Rank 3: A minor degree of residual image is observed but the image is still acceptable.

Rank 2: Some degree of residual image is observed.

Rank 1: A considerable degree of residual image is observed and therefore the images have problem.

5. Change of Potential ($P_L$) of Lighted Portion

The change of potential ($P_L$) of a lighted portion of the photoreceptor was measured during the exposure-development interval (Ted) to determine the potential decreasing rate, $\Delta V_L/\Delta T$ (i.e., the slope α in FIG. 13).

The evaluation results are shown in Table 1.

TABLE 1

| | | ΔVL/ΔT (V/sec) | | Abrasion | |
|---|---|---|---|---|---|
| | Transition time (msec) | Before running test | After running test | (μm) (30,000 copies) | Residual image |
| Ex. 1 | 77 | 550 | 570 | 0.2 | 4 |
| Comp. Ex. 1 | 73 | 350 | 400 | 3.0 | 5 |
| Comp. Ex. 2 | 90 | 750 | 740 | 0.2 | 1 |

As can be understood from the results in Table 1, a photoreceptor having a potential decreasing rate ($\Delta V_L/\Delta T$) not greater than 700 V/sec can produce images without residual images. The photoreceptor of Comparative Example 1 satisfies this condition, but the photoreceptor has poor abrasion and thereby the resultant images have background development. The photoreceptor of Comparative Example 2 produces uneven half tone images, and therefore the photoreceptor is not suitable for high speed image forming apparatus.

Example 2

The procedure for preparation and evaluation of the photoreceptor in Example 1 was repeated except that the protective layer coating liquid was changed to the following, the thickness of the protective layer was changed to 5 μm, the exposure-development interval was changed to 70 msec, and the number of copies in the running test was changed to 10,000 copies.

| Protective layer coating liquid | |
|---|---|
| Polyarylate resin (U-POLYMER U-100 from Unitika Ltd.) | 5 parts |
| Polyethylene wax (CERAFLOUR 991 from BYK-Cera) | 6 parts |
| Cyclohexanone | 80 parts |
| Tetrahydrofuran | 280 parts |

Example 3

The procedure for preparation and evaluation of the photoreceptor in Example 1 was repeated except that the protective layer coating liquid was changed to the following, the thickness of the protective layer was changed to 5 μm, the exposure-development interval was changed to 70 msec, and the number of copies in the running test was changed to 10,000 copies.

| Protective layer coating liquid | |
|---|---|
| Polyarylate resin (U-POLYMER U-100 from Unitika Ltd.) | 5 parts |
| Resistivity decreasing agent (BYK-P105 from BYK Chemie) | 0.2 parts |
| Polyethylene wax (CERAFLOUR 991 from BYK-Cera) | 6 parts |
| Cyclohexanone | 80 parts |
| Tetrahydrofuran | 280 parts |

Example 4

The procedure for preparation and evaluation of the photoreceptor in Example 1 was repeated except that the protective layer coating liquid was changed to the following, the thickness of the protective layer was changed to 5 μm, the exposure-development interval was changed to 70 msec, and the number of copies in the running test was changed to 10,000 copies.

| Protective layer coating liquid | |
|---|---|
| Charge transport polymer having formula (N) | 7 parts |
| Polyethylene wax (CERAFLOUR 991 from BYK-Cera) | 6 parts |
| Cyclohexanone | 80 parts |
| Tetrahydrofuran | 280 parts |

The evaluation results are shown in Table 2.

TABLE 2

| | Transition time (msec) | ΔVL/ΔT (V/sec) Before running test | ΔVL/ΔT (V/sec) After running test | Abrasion (μm) (10,000 copies) | Residual image |
|---|---|---|---|---|---|
| Ex. 2 | 82 | 640 | 650 | 0.31 | 4 |
| Ex. 3 | 87 | 570 | 570 | 0.31 | 5 |
| Ex. 4 | 83 | 390 | 400 | 0.33 | 1 |

As can be understood from Table 2, by including a CTM or a resistivity decreasing agent in the protective layer, the potential decreasing rate can be dramatically decreased, and thereby occurrence of the residual image problem can be prevented.

Example 5

Each of the following undercoat layer coating liquid, a CGL coating liquid and a CTL coating liquid was coated on an aluminum cylinder with a diameter of 30 mm and then dried to overlay an undercoat layer having a thickness of 3.5 μm, a CGL having a thickness of 0.2 μm, and CTL having a thickness of 20 μm.

| Undercoat layer coating liquid | |
|---|---|
| Alkyd resin (BEKKOZOL 1307-60-EL from Dainippon Ink & Chemicals, Inc.) | 10 parts |
| Melamine resin (SUPER BEKKAMIN G-821-60 from Dainippon Ink & Chemicals, Inc.) | 7 parts |
| Titanium dioxide (CR-EL from Ishihara Sangyo Kaisha Ltd.) | 40 parts |
| Methyl ethyl ketone | 200 parts |

| CGL coating liquid | |
|---|---|
| Titanyl phthalocyanine (manufactured by Ricoh Co., Ltd.) | 9 parts |
| Polyvinyl butyral (XYHL from Union Carbide Corp.) | 5 parts |
| Methyl ethyl ketone | 400 parts |

| CTL coating liquid | |
|---|---|
| Z-form polycarbonate resin (viscosity average molecular weight of 50,000, from Teijin Chemicals Ltd.) | 10 parts |
| CTM having formula (P) | 6 parts |
| Tetrahydrofuran | 100 parts |
| 1% tetrahydrofuran solution of silicone oil (silicone oil: KF50-100CS from Shin-Etsu Chemical Industry Co., Ltd.) | 1 part |

Then the following components were mixed and dispersed for 24 hours in a ball mill containing alumina balls to prepare a protective layer coating liquid. The protective layer coating liquid was coated by spray coating on the CTL and then dried to form a protective layer having a thickness of 4 μm.

| Protective layer coating liquid | |
|---|---|
| Z-form polycarbonate resin (viscosity average molecular weight of 50,000, from Teijin Chemicals Ltd.) | 7 parts |
| CTM having formula (P) | 6 parts |
| Polyethylene (HI-WAX 100P from Mitsui Chemicals, Inc.) | 1 part |
| Cyclohexanone | 280 parts |
| Tetrahydrofuran | 80 parts |

Thus, a photoreceptor of Example 5 was prepared.

Example 6

The procedure for preparation in Example 5 was repeated except that the CTL coating liquid was changed to the following.

| CTL coating liquid | |
|---|---|
| Z-form polycarbonate resin (viscosity average molecular weight of 50,000, from Teijin Chemicals Ltd.) | 10 parts |
| CTM having formula (P) | 9 parts |
| Tetrahydrofuran | 100 parts |
| 1% tetrahydrofuran solution of silicone oil (silicone oil: KF50-100CS from Shin-Etsu Chemical Co., Ltd.) | 1 part |

Thus, a photoreceptor of Example 6 was prepared.

Each of the photoreceptors was set in an electrophotographic image forming apparatus (IMAGIO NEO 270 manufactured by Ricoh Co., Ltd.) which had been modified so that the exposure-development interval is 65 msec, to perform a running test in which 10,000 copies of an image which includes a rectangular solid image and characters and which has an image area proportion of 5% are produced.

The toner and developer used are the exclusive toner and developer of IMAGIO NEO 270. In addition, the charger used is a short-range charging roller. When charging the photoreceptor, the DC bias was controlled so that the charged photoreceptor has a potential of −700 V. In addition, the development bias was −500 V. The image forming apparatus has a discharging device. The environmental conditions was 24° C. 54% RH.

The produced images were visually observed to check the evenness of the half tone images. The half tone images were graded as follows.

Rank 5: The half tone images are even.

Rank 4: The half tone images are very slightly uneven but are still acceptable.

Rank 3: The half tone images are slightly uneven.

Rank 2: The half tone images are uneven.

Rank 1: The half tone images are seriously uneven and therefore the half tone images have problem.

In addition, the transition time, the potential decreasing rate, the mobility (μ) of each CTL and the dependence β ($=\log \mu/E^{1/2}$) of the charge mobility on electric field strength were also measured.

The evaluation results are shown in Table 3.

TABLE 3

| | | ΔVL/ΔT (V/sec) | | | | Half |
|---|---|---|---|---|---|---|
| | Transition time (msec) | Before running test | After running test | Mobility ($cm^2/V \cdot sec$) | β | tone image (rank) |
| Ex. 5 | 78 | 400 | 420 | $9.0 \times 10^{-6}$ | $1.5 \times 10^{-3}$ | 4 |
| Ex. 6 | 70 | 350 | 355 | $6.5 \times 10^{-5}$ | $1.5 \times 10^{-3}$ | 5 |

As can be understood from the data in Table 3, the photoreceptors of Examples 5 and 6 have small potential decreasing rate, and thereby the produced images have good qualities.

Example 7

The procedure for preparation of the photoreceptor in Comparative Example 2 was repeated except that the protective layer coating liquid was changed to the following while the coating conditions were also changed as follows.

| Protective layer coating liquid | |
|---|---|
| Z-form polycarbonate resin (viscosity average molecular weight of 50,000, from Teijin Chemicals Ltd.) | 7 parts |
| α-alumina (SUMICORUNDUM AA-07 from Sumitomo Chemical Co., Ltd.) | 3 parts |
| Resistivity decreasing agent (BYK-P105 from BYK Chemie) | 0.2 parts |
| Cyclohexanone | 40 parts |
| Tetrahydrofuran | 320 parts |

| Coating conditions | | |
|---|---|---|
| Spray coating conditions | Ex. 7 | Comp. Ex. 2 |
| Coating liquid discharge rate (ml/min) | 15 | 15 |
| Coating liquid discharge pressure ($kgf/cm^2$) | 2.0 | 3.0 |
| Rotating speed of drum substrate (rpm) | 360 | 360 |
| Coating speed (mm/sec) | 24 | 24 |
| Distance between spray head and drum substrate (cm) | 8 | 12 |
| Number of times of coating (times) | 4 | 5 |
| W1/W2* | 1.5 | 2.1 |

Note*:
W1 represents the weight of the protective layer, which is measured after coating the protective layer coating liquid and allowing the coated liquid to settle for 1 hour under conditions of 25 ± 3° C. and 53 ± 5% RH; and W2 represents the weight of the protective layer, which is measured after coating the protective layer coating liquid and drying the coated liquid for 30 minutes at 150° C.

The thus prepared photoreceptor was evaluated in the same way as that in Example 1.

The results are shown in Table 4.

TABLE 4

| | | ΔVL/ΔT (V/sec) | | Abrasion | |
|---|---|---|---|---|---|
| | Transition time (msec) | Before running test | After running test | (μm) (30,000 copies) | Residual image |
| Ex. 7 | 86 | 680 | 690 | 0.2 | 3 |

As a result, it is found that by coating the protective layer coating liquid under conditions such that the ratio W1/W2 is from 1.3 to 1.9, the potential decreasing rate can be controlled so as to be not greater than 700 V/sec, and thereby occurrence of residual images can be prevented.

Example 8

Each of the following undercoat layer coating liquid, a CGL coating liquid and a CTL coating liquid was coated on an aluminum cylinder with a diameter of 30 mm and then dried to overlay an undercoat layer having a thickness of 2.8 μm, a CGL having a thickness of 0.5 μm, and CTL having a thickness of 24 μm.

| Undercoat layer coating liquid | |
|---|---|
| Alkyd resin (BEKKOZOL 1307-60-EL from Dainippon Ink & Chemicals, Inc.) | 10 parts |
| Melamine resin (SUPER BEKKAMIN G-821-60 from Dainippon Ink & Chemicals, Inc.) | 7 parts |
| Titanium dioxide (CR-EL from Ishihara Sangyo Kaisha Ltd.) | 40 parts |
| Methyl ethyl ketone | 200 parts |

| CGL coating liquid | |
|---|---|
| Bisazo pigment having formula (M) | 2.5 parts |
| Polyvinyl butyral (XYHL from Union Carbide Corp.) | 0.25 parts |
| Cyclohexanone | 200 parts |
| Methyl ethyl ketone | 80 parts |

| CTL coating liquid | |
|---|---|
| Charge transport polymer having formula (N) (weight average molecular weight of 110,000) | 13.5 parts |
| CTM having formula (P) | 1.5 parts |
| Tetrahydrofuran | 85 parts |
| 1% tetrahydrofuran solution of silicone oil (silicone oil: KF50-100CS from Shin-Etsu Chemical Industry Co., Ltd.) | 1 part |

Then the following components were mixed and dispersed for 24 hours in a ball mill containing alumina balls to prepare a protective layer coating liquid. The protective layer coating liquid was coated by spray coating on the CTL and then dried to form a protective layer having a thickness of 6 μm.

| Protective layer coating liquid | |
|---|---|
| Z-form polycarbonate resin (viscosity average molecular weight of 50,000, from Teijin Chemicals Ltd.) | 7 parts |
| CTM having formula (P) | 5 parts |
| α-alumina (SUMICORUNDUM AA-03, from Sumitomo Chemical Co., Ltd.) | 3.5 parts |
| Resistivity decreasing agent (BYK-P105 from BYK Chemie) | 0.05 parts |
| Cyclohexanone | 80 parts |
| Tetrahydrofuran | 280 parts |

Thus, a photoreceptor of Example 8 was prepared.

The thus prepared photoreceptor was evaluated in the same way as that in Example 1 except that the exposure-development interval was changed to 65 msec.

The results are shown in Table 5.

TABLE 5

| | Transition time (msec) | ΔVL/ΔT (V/sec) Before running test | ΔVL/ΔT (V/sec) After running test | Abrasion (μm) (30,000 copies) | Residual image |
|---|---|---|---|---|---|
| Ex. 8 | 76 | 670 | 660 | 0.4 | 3 |

Example 9

The procedure for preparation and evaluation of the photoreceptor in Example 8 was repeated except that the exposure-development interval was changed to 85 msec.

As a result, the produced images are graded as rank 5 with respect to residual image.

Namely, it can be said that when the transition time of the photoreceptor used for an image forming apparatus is less than the exposure-development interval of the image forming apparatus, the residual image problem is hardly caused.

As mentioned above, the photoreceptor of the present invention can produce images without causing the residual image problem.

This document claims priority and contains subject matter related to Japanese Patent Application No. 2003-076650, filed on Mar. 19, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor, comprising:

an electroconductive substrate;

a photosensitive layer overlying the substrate; and a protective layer overlying the photosensitive layer, wherein the photoreceptor has a the property such that when the photoreceptor is charged so as to have a potential of −700 V and then is exposed to light at an exposure intensity of 0.4 μJ/cm$^2$, the potential ($P_L$) of a light exposed portion of the photoreceptor decreases at a rate not greater than 700 V/sec during a time period ranging from a time of 35 msec after said exposure to a transition time of the photoreceptor.

2. The photoreceptor according to claim 1, wherein the protective layer comprises a charge transport material.

3. The photoreceptor according to claim 2, wherein the charge transport material is a charge transport polymer.

4. The photoreceptor according to claim 3, wherein the charge transport polymer has a triaryl amine structure.

5. The photoreceptor according to claim 1, wherein the photosensitive layer comprises a charge generation layer and a charge transport layer, which are overlaid.

6. The photoreceptor according to claim 5, wherein the charge transport layer has a charge mobility (μ) not less than $1.2\times10^{-5}$ cm$^2$/V·sec at an electric field strength of $4\times10^5$ V/cm, and wherein dependence (β) of the charge mobility on the electric field strength (E) is not greater than $1.6\times10^{-3}$, wherein $\beta=\log \mu/E^{1/2}$.

7. A method for manufacturing the photoreceptor according to claim 1, comprising:

spray-coating a protective layer coating liquid that comprises a solvent in which a resin, that is present in the photosensitive layer, is dissolved, on the photosensitive layer, wherein the following relationship is satisfied:

$$1.3 < W1/W2 < 1.9$$

wherein W1 represents the weight of the coated protective layer, which is measured after coating the protective layer coating liquid and allowing the coated liquid to settle for 1 hour under the conditions of 25±3° C. and 53±5% RH, and W2 represents the weight of the coated protective layer, which is measured after coating the protective layer coating liquid and drying the coated liquid for 10 minutes or more at a temperature not lower than the boiling point of the solvent.

8. An image forming apparatus, comprising:

the photoreceptor according to claim 1;

a charger configured to charge the photoreceptor;

a light irradiator configured to irradiate the photoreceptor with imagewise light to form an electrostatic latent image on the photoreceptor;

an image developer configured to develop the electrostatic latent image with a toner to form a toner image on the photoreceptor; and a transfer device configured to transfer the toner image to a receiving material optionally via an intermediate transfer medium, wherein the interval between the light irradiation step and the development step is not greater than 100 ms.

9. The image forming apparatus according to claim 8, wherein the transition time of the photoreceptor is not greater than the interval between the light irradiation step and the development step.

10. A process cartridge, comprising:

the photoreceptor according to claim 1; and at least one charger configured to charge the photoreceptor;

a light irradiator configured to irradiate the photoreceptor with imagewise light to form an electrostatic latent image on the photoreceptor;

an image developer configured to develop the electrostatic latent image with a toner to form a toner image on the photoreceptor;

a transfer device configured to transfer the toner image to a receiving material optionally via an intermediate transfer medium;

a cleaner configured to clean a surface of the photoreceptor; and a discharger configured to reduce charges remaining on the photoreceptor.

* * * * *